US007712494B2

(12) United States Patent
Janzen

(10) Patent No.: US 7,712,494 B2
(45) Date of Patent: May 11, 2010

(54) METHOD AND APPARATUS FOR PROFILING A LOG FOR USE IN BUILDING TIMBER OR LOG HOMES

(76) Inventor: Martin Janzen, P.O. Box 222, Horsefly, British Columbia (CA) V0L 1L0

( * ) Notice: Subject to any disclaimer, the term of this patent is extended or adjusted under 35 U.S.C. 154(b) by 797 days.

(21) Appl. No.: 11/592,156

(22) Filed: Nov. 3, 2006

(65) Prior Publication Data

US 2008/0105335 A1 May 8, 2008

(51) Int. Cl.
*B27C 9/00* (2006.01)

(52) U.S. Cl. ..... 144/359; 144/376; 144/378; 144/3.1; 83/442

(58) Field of Classification Search ..... 144/344, 144/345, 354, 359, 363, 376, 378, 3.1, 2.1, 144/1.1, 360, 361; 83/382, 412, 415, 442
See application file for complete search history.

(56) References Cited

U.S. PATENT DOCUMENTS

| | | | | |
|---|---|---|---|---|
| 1,496,982 | A | 6/1924 | Dunham | |
| 3,438,412 | A | 4/1969 | Zeigler | |
| 3,695,316 | A | 10/1972 | Pluckhahn | |
| 3,946,774 | A | 3/1976 | McCord, Jr. | |
| 3,951,187 | A | 4/1976 | Chisum | |
| 3,954,037 | A | 5/1976 | Rios | |
| 4,168,675 | A | 9/1979 | Chisum | |
| 4,227,557 | A | 10/1980 | Allen | |
| 4,275,632 | A | 6/1981 | Ross | |
| 4,307,641 | A | 12/1981 | Shapleigh | |
| 4,392,520 | A * | 7/1983 | Wrightman | 144/363 |
| 4,519,429 | A | 5/1985 | Dreese | |
| 4,660,454 | A | 4/1987 | Elsey | |
| 4,899,795 | A | 2/1990 | Hackett | |
| 4,938,263 | A * | 7/1990 | Wrightman | 144/422 |
| 5,035,166 | A | 7/1991 | Carlson et al. | |
| 5,065,802 | A | 11/1991 | Peterson | |
| 5,109,899 | A | 5/1992 | Henderickson | |
| 5,505,028 | A * | 4/1996 | Giles | 52/233 |
| 5,806,401 | A | 9/1998 | Rajala et al. | |
| 6,128,994 | A | 10/2000 | Phelps | |
| 6,640,855 | B2 | 11/2003 | Giles | |
| 6,675,846 | B1 | 1/2004 | Hoffman | |

* cited by examiner

*Primary Examiner*—Shelley Self
(74) *Attorney, Agent, or Firm*—Anthony C. Edwards

(57) ABSTRACT

A log profiler for sawing surfaces into and along the length of a log may be characterized as including a saw carriage selectively translatable along a track, a pair of log holders on the track for holding the log suspended over and along the track and adapted to selectively rotate the log about its long axis, a linear double-acting saw blade mounted on a blade carriage, the blade translatable linearly along the blade carriage relative to both the blade carriage and saw carriage, the blade carriage selectively rotatable and selectively elevatable relative to the saw carriage.

25 Claims, 21 Drawing Sheets

METHOD AND APPARATUS FOR PROFILING A LOG FOR USE IN BUILDING TIMBER OR LOG HOMES

FIELD OF THE INVENTION

This invention relates to the field of machines for sawing logs and in particular to a log profiling machine for profiling a cant from a log and for cutting compound dovetail joints into the ends of the log.

BACKGROUND OF THE INVENTION

In the prior art applicant is aware of U.S. Pat. No. 6,640,855 which issued Nov. 4, 2003 to Giles for a Log Home Fabrication Process and Associate Log Cutting Machine. As Giles observes, in the construction of log structures, a four sided cant or, for a more natural looking log wherein the natural contoured edges are left, using a two sided cant, the log must be further processed if the log is to be used in the construction of walls. Hence, each end of the log is cut with some sort of intersecting notch, that is, a dovetail so that the ends of the logs may be interlocked to form the corner of the structure as seen in FIG. 1 herein which is a representation of the compound dovetailed corner of a log structure illustrated in the Giles patent.

As Giles describes, conventionally, a rectangular log has the necessary joinery cuts made in the log by a joinery machine, the straight edges of the rectangular log enabling the joinery machine to make the necessary cuts with precision. According to Giles, the straight edges of the log cant greatly simplify the manufacturing process, and logs which still have the natural external contour of the raw timber log in place on opposed edges of the log, such as two sided cants, cannot be so easily processed because the width of the log will vary along its length. Consequently, Giles describes an apparatus for cutting such two sided cants a guide aligns the log centreline with respect to a log cutter, and a controller controls movement of the log substantially horizontally along a support and also controls the cutter itself. The example is given that the guide may be attached directly to the log so that the guide maintains contact with a fence leading to the cutter. It is also taught that the guide may be a fence guide attached to the fence, or that the guide may be alignment elements forming a portion of the log mover. In all three embodiments, the guide maintains the log centreline substantially parallel to the fence at fixed distance from the fence as the log is moved to the cutter.

In the present invention no fence is required at all and thus the requirement for guides as taught by Giles is removed, the arrangement of the present invention as better described below, allowing for all measurements to be made from the centre of the log, that is, the axis of rotation common between the rotatable end carriers on either end of the log thereby removing the problem of dealing with tapered cants etc. The present invention also provides for the use of spaced apart pair of splines between adjacent logs thereby allowing for insulation to be inserted between the splines while retaining the rustic outward appearance of a log wall structure.

In the prior art applicant is also aware of U.S. Pat. No. 6,675,846 which issued Jan. 13, 2004 to Hoffman for A Lineal Log Peeler and Debarker for Use in Log Home Construction. Hoffman discloses a machine which replaces hand-peeling of logs with a draw knife wherein a log is end dogged between spindles, one of which is a drive spindle and a cutter head lowered into engagement with the logs so as to debark the log as the cutter head travels slowly down the length of the log.

Applicant is also aware of U.S. Pat. No. 5,109,899 which issued May 5, 1992 to Hendrickson for a Cant-Making Apparatus and Process which discloses the use of circular saws for cutting a log held at opposite ends of the log. The log may be rotated relative to a frame on which is mounted an overhead sawing device moveable along a track extending along the log. Cants may thus be made having contiguous flat chordal sides which are principally clear wood so that in subsequent milling operations the cants may be cut by conventional sawing apparatus to clear lumber or sliced into edge-grain veneer.

Applicant is also aware of U.S. Pat. No. 3,695,316 which issued Oct. 3, 1972 to Pluckhahn for a device for Sawing Timber, Pluckhahn providing a portable timber milling jig having a beam along which runs a carriage for supporting a chainsaw or reciprocating saw. The beam is supported at either end by a vertical stand which is also clamped into a corresponding end of the log to be sawn so that the log is positioned below the beam, the saws then cutting the log as the carriage is moved along the beam.

SUMMARY OF THE INVENTION

In summary, the log profiler according to the present invention for sawing surfaces into and along the length of a log may be characterized as including a saw carriage selectively translatable along a track, a pair of log holders on the track for holding the log suspended over and along the track and adapted to selectively rotate the log about its long axis, a linear double-acting saw blade mounted on a blade carriage, the blade translatable linearly along the blade carriage relative to both the blade carriage and saw carriage, the blade carriage selectively rotatable and selectively elevatable relative to the saw carriage.

In particular the log profiler may include:

a) an elongate frame having opposite first and second ends;

b) a track rigidly mounted onto the frame from the first end to the second end;

c) a saw carriage mounted onto the track for selective translation of the carriage longitudinally in both forward and reverse directions along the track and defining a sawing cavity over the track;

d) a double-acting saw blade mounted on a feed for selective translation therealong, the feed mounted on a blade carriage, the blade carriage rotatably mounted for rotation of the blade and feed about a transverse axis and vertically translatable in the saw carriage, the blade carriage mounted in the cavity so as to dispose the blade across the cavity and laterally across the track and so that rotation of the blade carriage rotates the blade and the feed about the transverse axis extending along the length of the blade relative to a log mounted parallel to the track and journalled through the cavity, wherein the double-acting saw blade is adapted to saw the log in both the forward and reverse directions;

e) first and second log holders rotatably mounted, respectively, at the first and second ends of the frame and aligned with the track and selectively positionable relative to the track so that the log is held clamped between the log holders and substantially horizontally parallel to the track in a cutting path of the blade, the log holders rotatably mounted so as to be selectively rotatable about an axis of rotation of the log, the log holders adapted for mounting to the opposite ends of the log at substantially the centroids of the opposite ends so that rotation of the log about the axis of rotation rotates the log about substantially a centroidal longitudinal axis of the log;

f) a log rotation drive mounted at the first log holder for selectively rotating the log about the axis of rotation by a desired angle for canting the log or dovetail jointing the ends of the log so that translation of the saw carriage along the track when the blade is positioned for cutting engagement with the log cuts the log along the cutting path to thereby cant the log when the saw carriage is translated the length of the log, or to position the log about its longitudinal axis for cutting compound dovetail-joint ends in the log;

g) wherein, when cutting the compound dovetail-joint ends, the blade carriage and log are positioned to angle the blade at a compound angle relative to the log by rotation of the log to a first angle of the compound angle and by rotation of the blade about the lateral axis so as to incline the blade to a second angle of the compound angle, wherein the first and second angles are orthogonal to one another, so that a compound angle joint saw cut is made at the compound angle as the saw is translated on the feed inwardly from an end being jointed.

Double spline cutting saws may be mounted to the saw carriage and within the carriage cavity for cutting a parallel, transversely spaced apart pair of longitudinally extending substantially linear spline receiving grooves along the length of the log. The spline cutting saws are mounted so as to be selectively movable relative to the saw carriage into cutting engagement with the log. In particular, the double spline cutting saws may be mounted to an upper end of the saw carriage and may be selectively lowerable downwardly into the cavity to engage an upper surface of the log.

A calibrated scale may be provided cooperating with the log rotation drive so as to indicate to a user an angular displacement of the log by the log rotation drive about the axis of rotation. The scale may be mounted for rotation co-axially with the log whereby the angular displacement is indicated directly by corresponding rotation of the scale.

The saw blade advantageously may be substantially linear and extend between the upright. The axis of rotation and the transverse axis may be orthogonal and substantially horizontal. In particular the saw blade may be a chainsaw extending along the transverse axis, and may further include a saw drive mounted to the saw carriage and cooperating with the saw blade for actuating the saw blade for sawing the log.

The saw carriage may be formed as an inverted, substantially U-shape having uprights extending vertically on opposite sides of the log and the cutting path. The second feed may be a linear actuator for actuating the blade along a plane which is selectively inclined by rotation of the blade carriage.

The present invention also includes a corresponding method of profiling and compound-angle jointing of a log. The method includes the steps of:

a) providing the above apparatus summarized above;

b) determining a desired cant profile for the log, c) rotating the log to an angular orientation about the axis of rotation corresponding to the desired cant profile so that sawing by the saw blade along the cutting path produces the desired cant profile, d) determining the first and second angles and corresponding angular orientations of the log about the axis of rotation and the saw blade about the transverse axis, e) positioning the log and the saw blade for sawing along the first and second angles to thereby saw a compound angle joint in an end of the log, f) actuating the saw blade so as to saw the log and simultaneously translating the saw blade to translate the saw blade longitudinally relative to the log and to simultaneously translate the saw blade on the feed inclined or otherwise selectively oriented relative to the log so as to follow the first and second angles to produce the compound-angle joint in the end of the log.

The method may further include the steps of measuring desired saw cuts for canting the log or jointing an end of the log from the centroidal axis of the log, where the centroidal axis extends longitudinally along the log and the axis of rotation. The step of measuring the first angle may be done using the scale so as to rotate the log about the axis of rotation to an angular orientation corresponding to the first angle.

DETAILED DESCRIPTION OF EMBODIMENTS OF THE INVENTION

Figure 1:
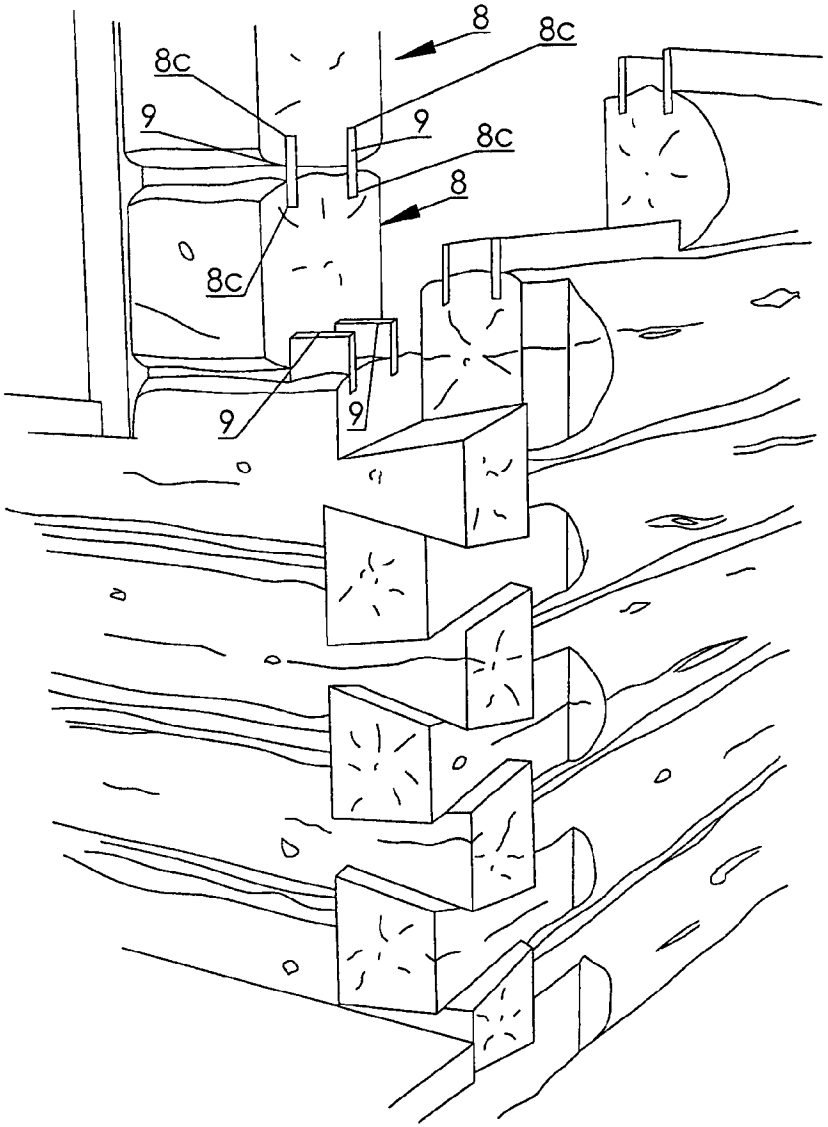
FIG. 1 is, in perspective view, a partially cut away assembly of dovetail jointed logs illustrating the compound dovetail angles and splining accomplished by the present invention.

As seen in the accompanying figures wherein like reference numerals denote corresponding parts in each view, the log profiling machine 2 according to the present invention includes a frame 4, a pair of log supports 6 mounted at opposite ends of the frame 4 for holding a log 8 elevated from, and parallel to, the frame 4 for selective rotation of the log about a log axis of rotation A. Log lifters 10 are used to raise each end of log 8 for engagement by, so as to be clamped between, log end holders 12 by the use of mounting plates 12*a*. Long logs may however tend to sag, the amount of the sag at the center depending on length and thickness. For such longer logs, for example those logs longer than sixteen feet, an auxiliary lifting device such as a screw jack (not shown) may be placed on the center tracks at approximately the mid-point along the length of the log.

Figure 2:
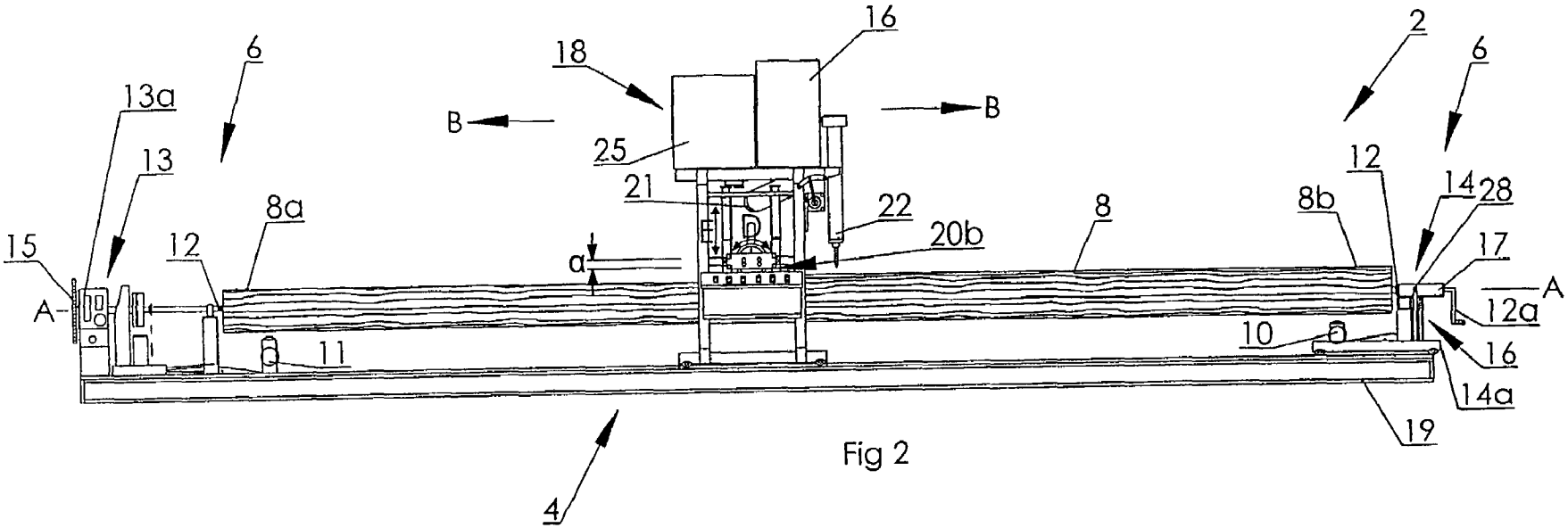
FIG. 2 is, in front elevation view, the log processing apparatus according to the present invention operating.

Log end holders engage and hold the ends of log 8. The log end holder 12 at a first or driven end 8*a* of log 8 is rotated by a rotation drive unit 13. The log end holder 12 at the opposite end, the second or carrier end 8*b* of log 8, is passively rotated on a rotatable carrier 14. Rotation drive unit 13 includes a scale 15 which indicates the amount by which log 8 has been rotated about axis A (see FIG. 2) by rotation drive unit 13. The lifting of log 8 by log lifter 10, and the rotation of log 8 about axis A are controlled by controls 13*a* located on rotation drive unit 13. A control valve and knob 13*b* provides for lowering of log lifter 10.

Rotatable carrier 14 is mounted on a trolley 14*a* so that the position of the rotatable carrier 14 may be adjusted relative to frame 4. A braking system 16 is also mounted on trolley 14*a* so as to selectively and releasably lock the position of trolley 14*a*. Rotatable carrier 14 includes a means 17 for urging log 8 against the log end holder 12 of rotation drive unit 13 wherein such means 17 may include, without intending to be limiting, a tail stock type mechanism mounted within rotatable carrier 14 and actuated by an actuator for example such as manually operable crank 17*a*. By means of rotation drive unit 13 and rotatable carrier 14, log 8 is maintained with its longitudinal axis along axis of rotation A and substantially parallel to frame 4. Thus when log 8 is rotated and is sawn as described below, all measurements and angles remain parallel to the axis of rotation A.

Linear tracks 19 are mounted along the opposite outer edges of frame 4. Saw carriage 18 translates along tracks 19 by means of rollers or wheels 18*a* which are rotatably mounted at the lower end of a rigid saw supporting frame 18*b* which extends in a generally inverted U-shape over, so as to extend between, the opposed pair of parallel tracks 19.

Figure 4:
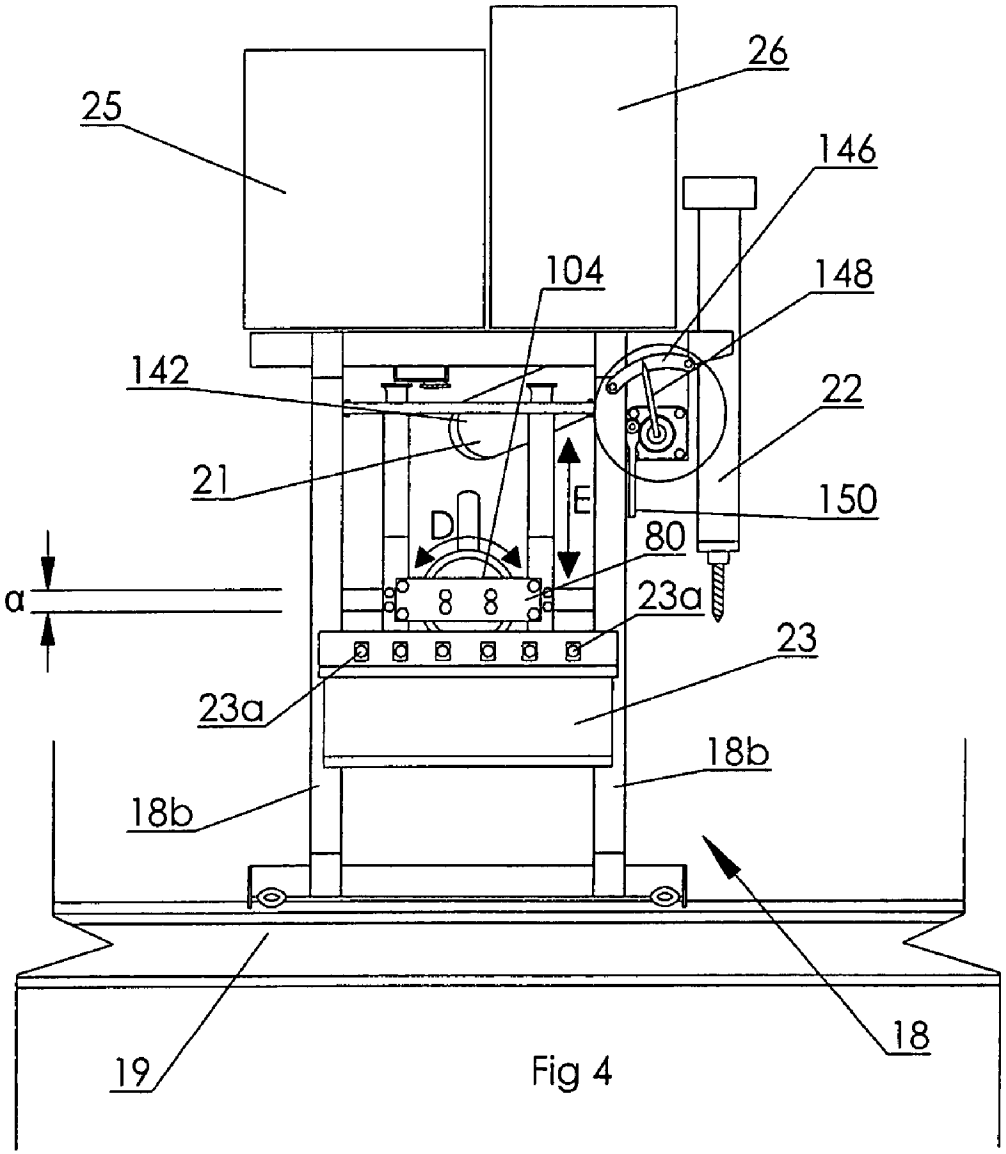
FIG. 4 is, in enlarged view, the saw carriage portion of the apparatus of FIG. 2.
Figure 5:
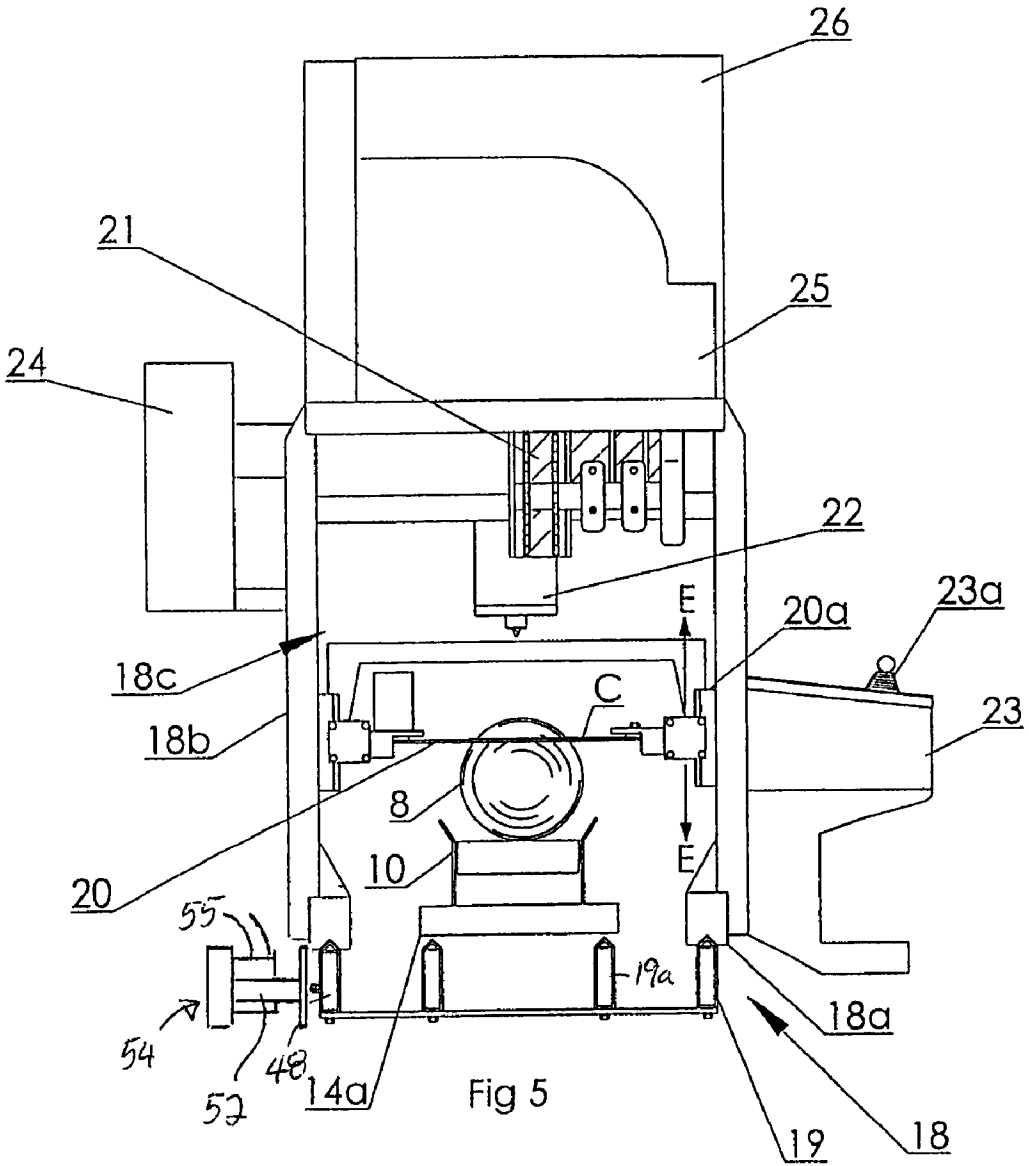
FIG. 5 is, in left side elevation view, the apparatus of FIG. 2.
Figure 6:
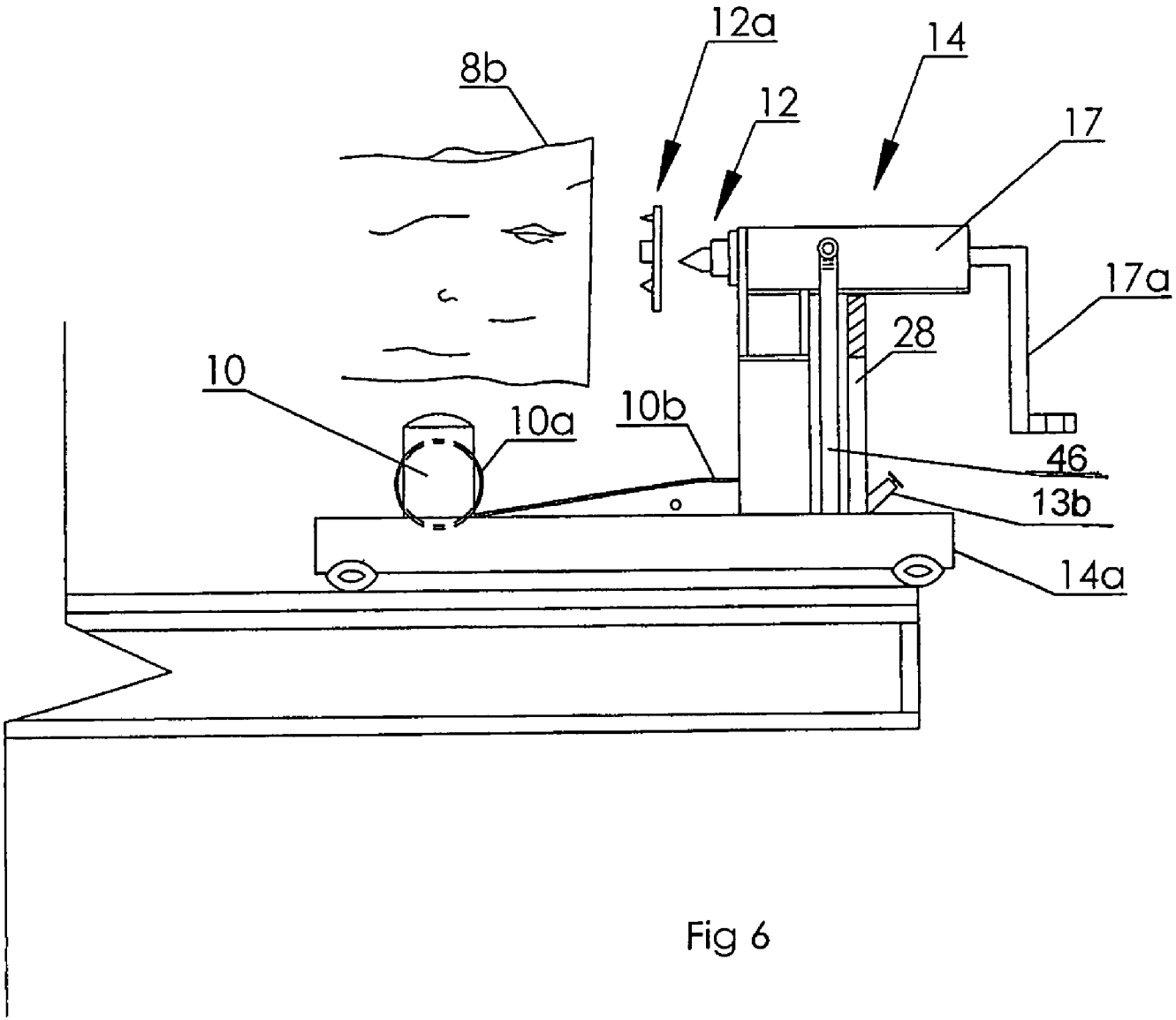
FIG. 6 is, in enlarge view, the right hand side of the view of FIG. 2 illustrating the opposite log end holder.
Figure 7A:
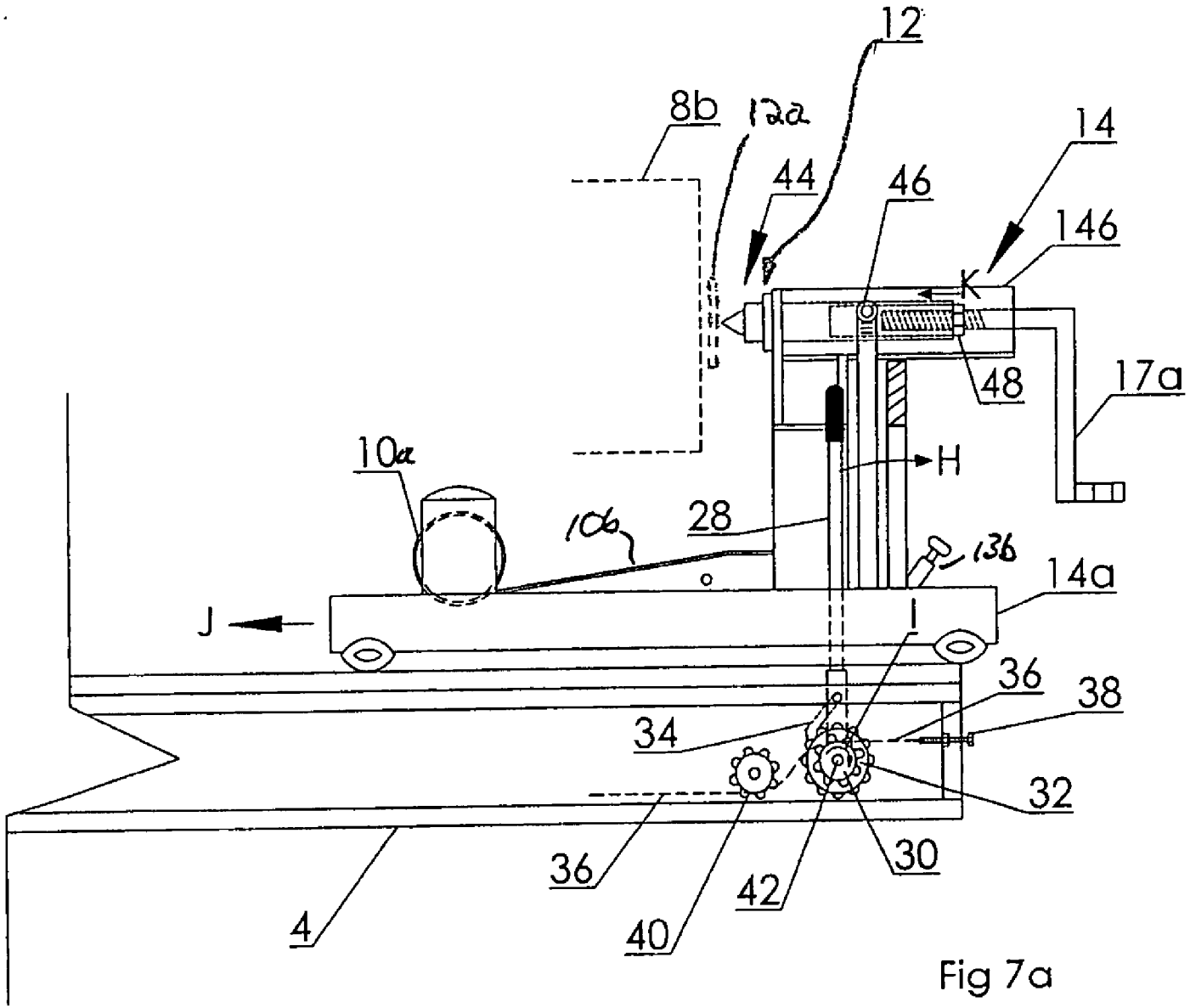
FIG. 7*a* is the log end holder of FIG. 6 illustrating hidden detail in dotted outline.
Figure 7B:
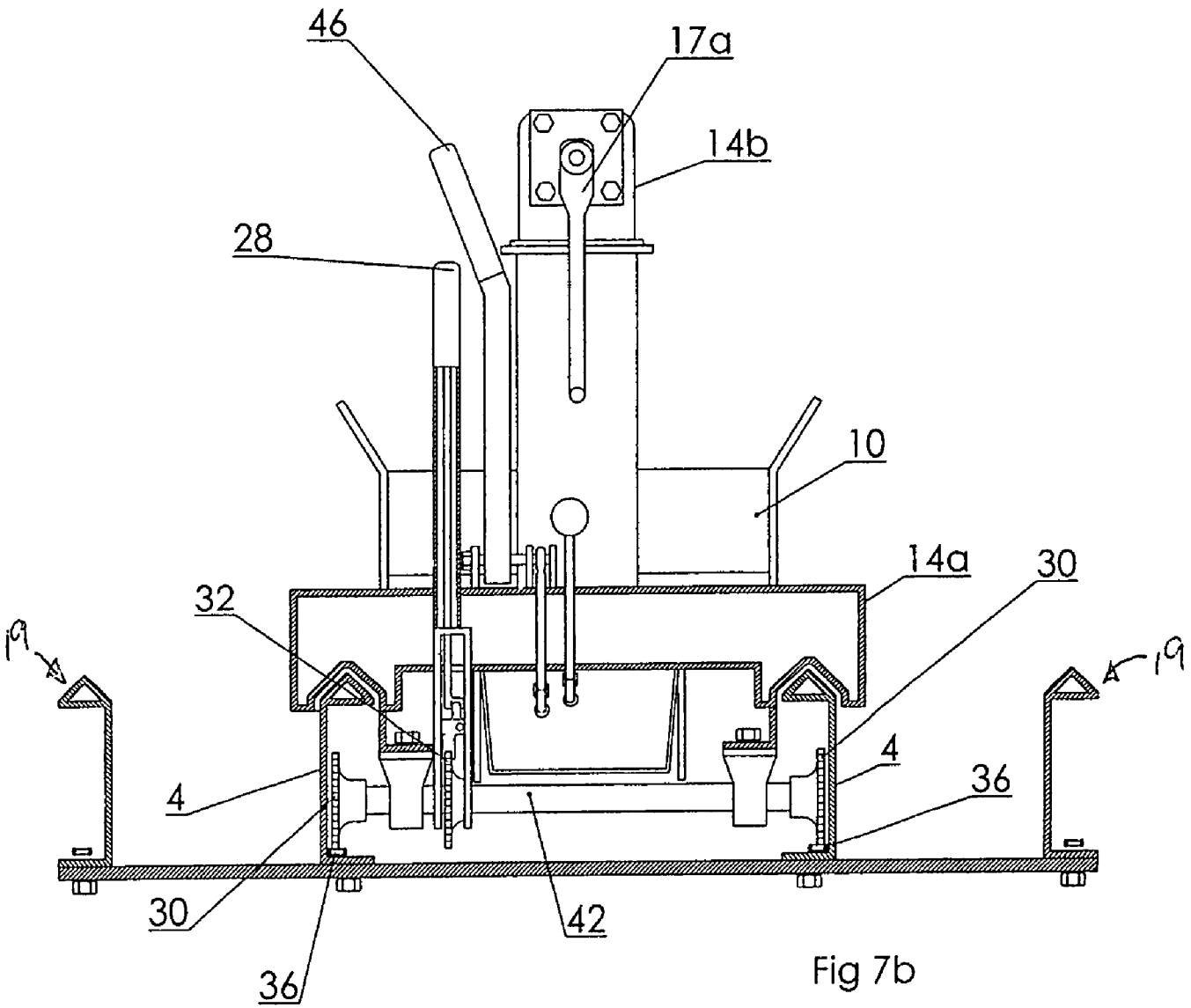
FIG. 7*b* is, in right side elevation view, the log end holder of FIG. 6.
Figure 8A:
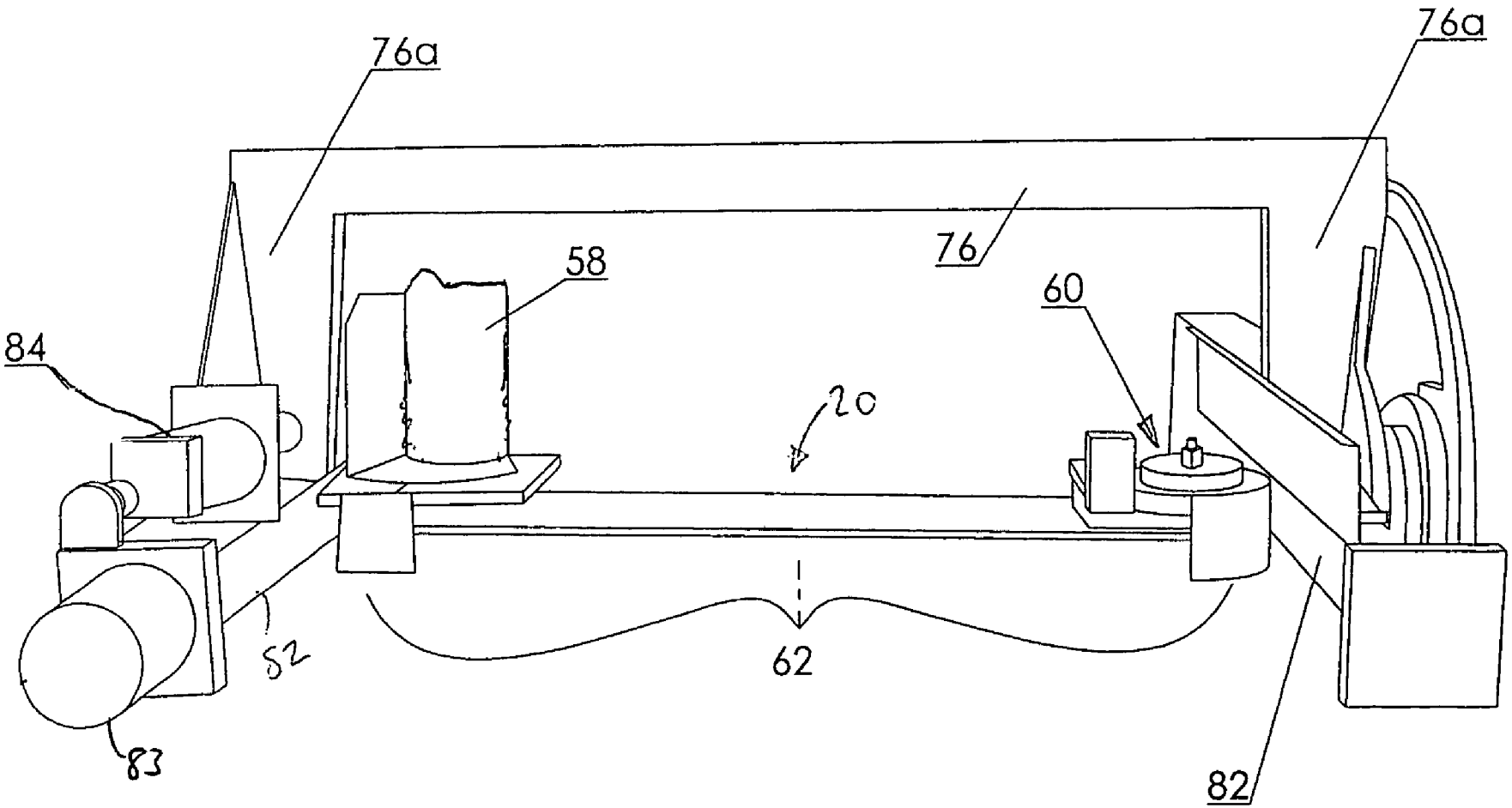
FIG. 8*a* is, in side perspective view, the saw blade and saw blade supporting platform which is rotatably mounted within the saw carriage of FIG. 2.
Figure 8B:
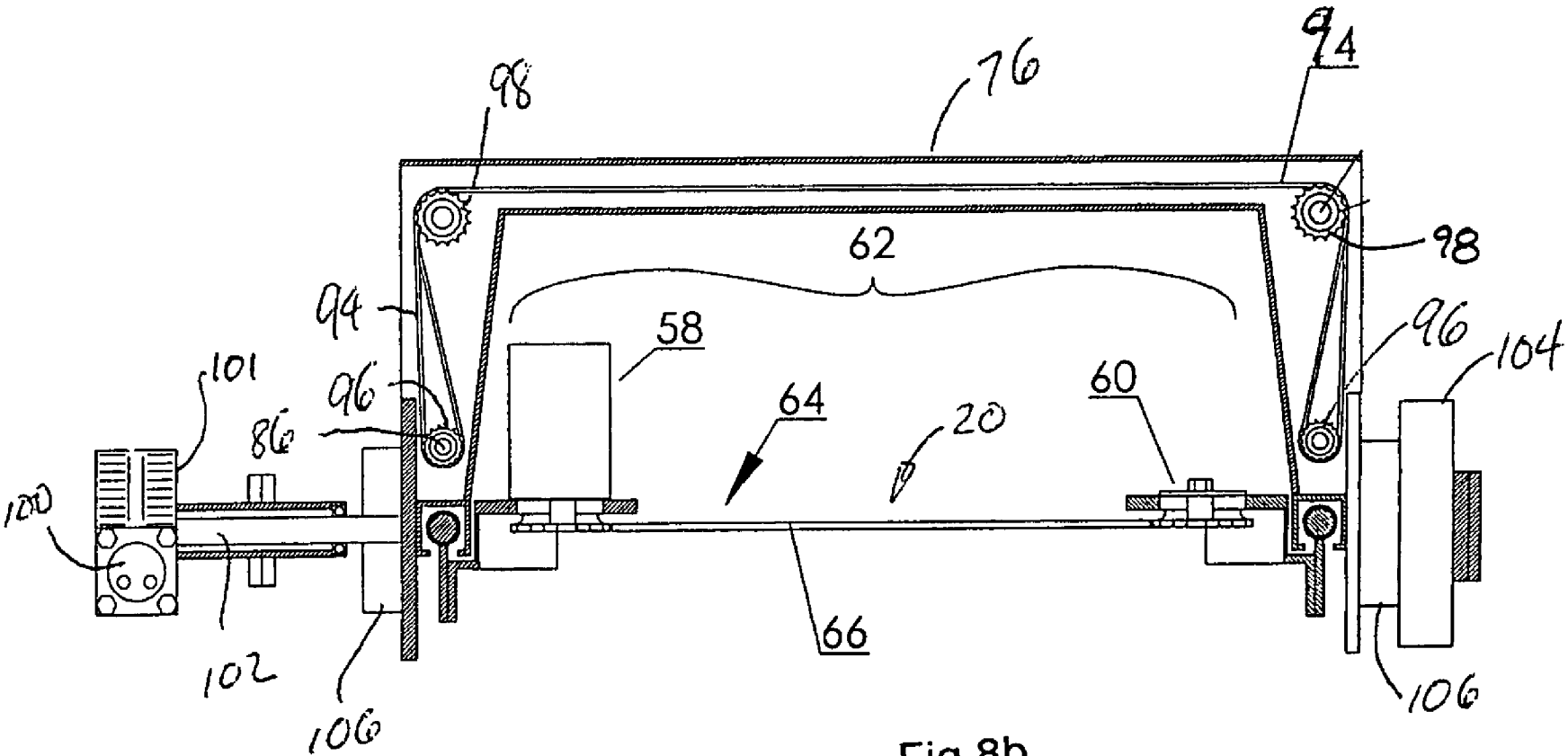
FIG. 8*b* is the elevation view of the view of FIG. 8*a* sectioned so as to illustrate the endless drive chain driving the pair of threaded rods to translate the saw relative to the saw supporting platform.
Figure 9:
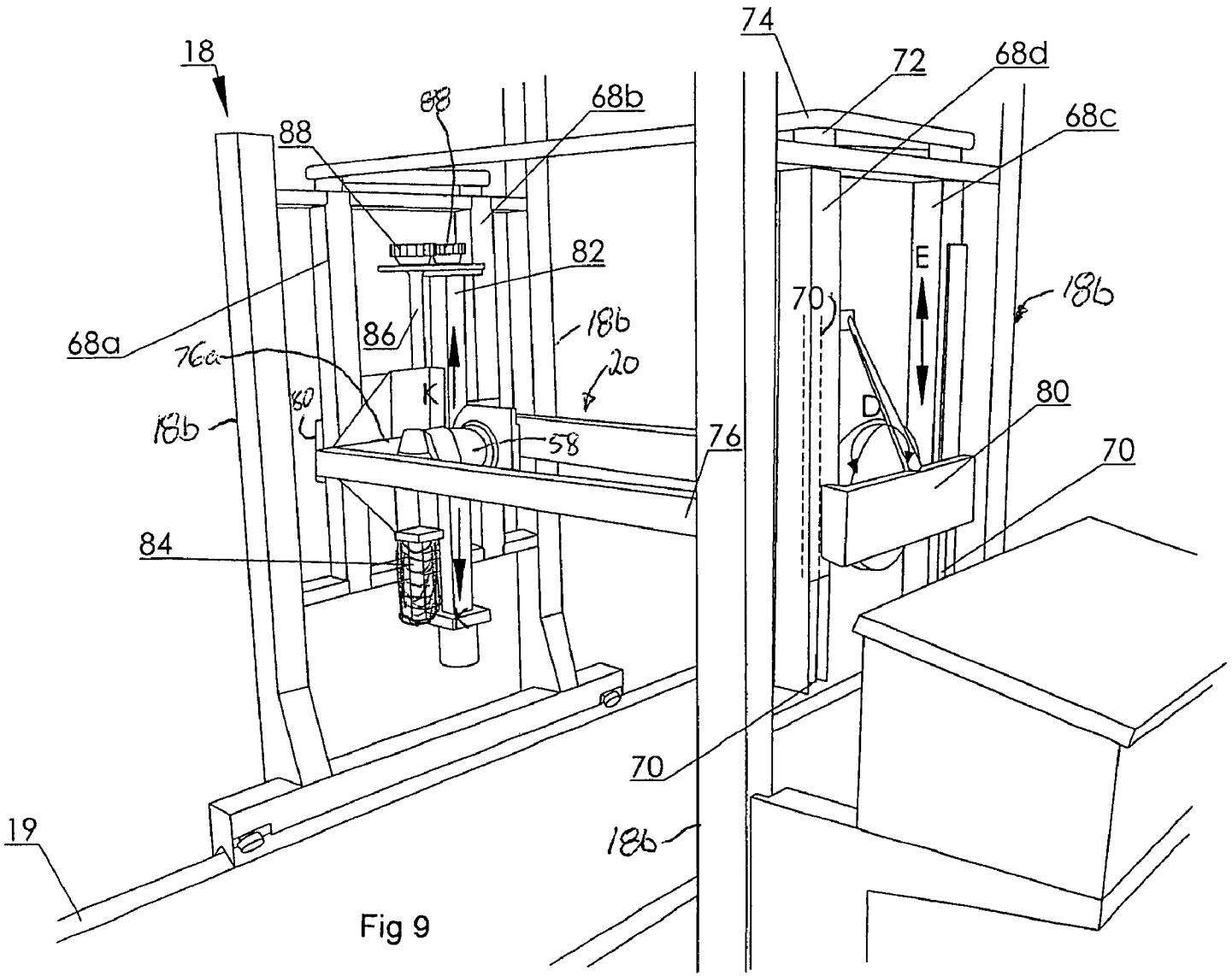
FIG. 9 is, in perspective view, the saw carriage of FIG. 2.
Figure 10:
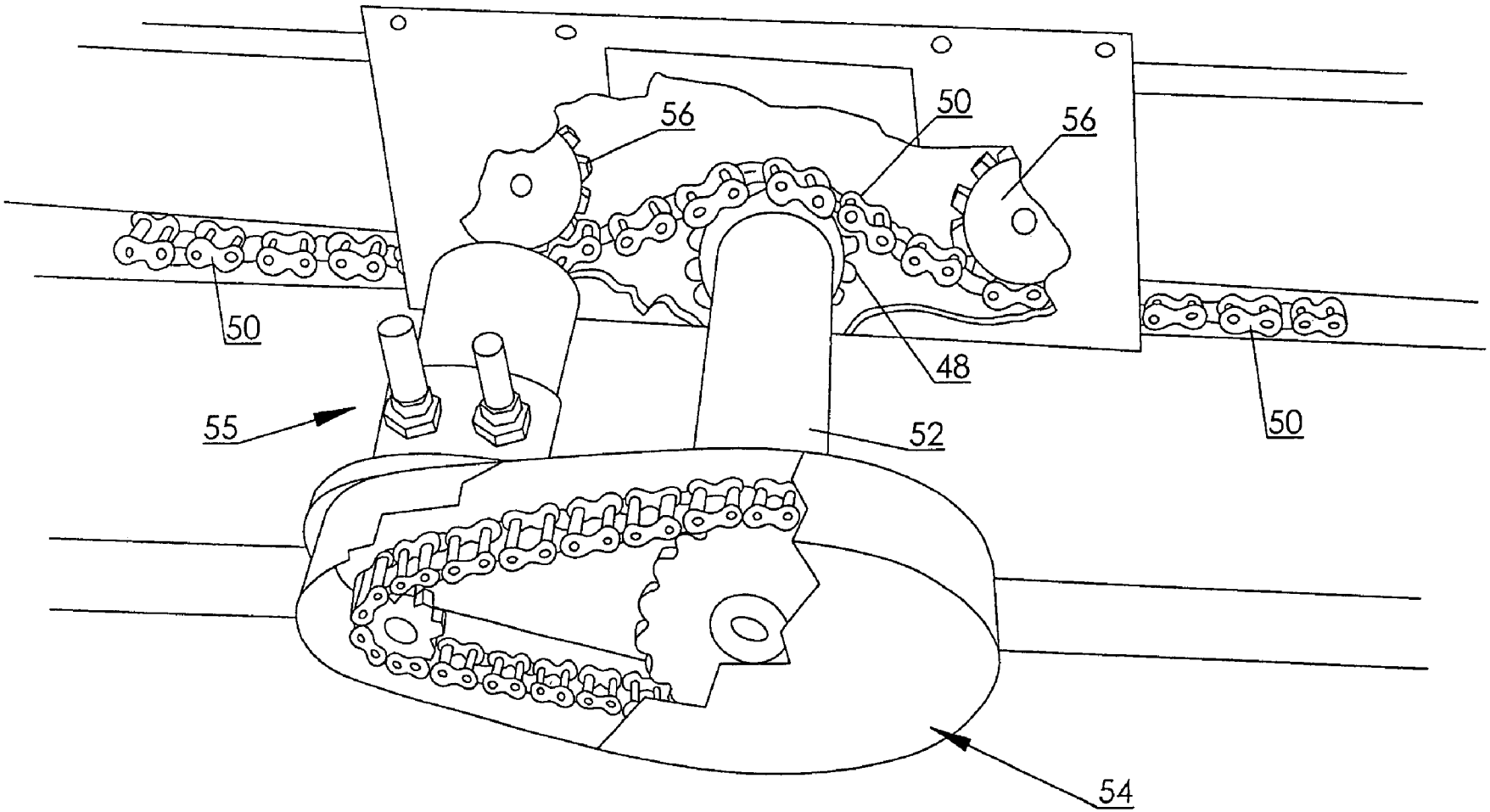
FIG. 10 is, in partially cut away front perspective view, the hydraulic motor and reduction gears driving the saw carriage along the rails.
Figure 11:
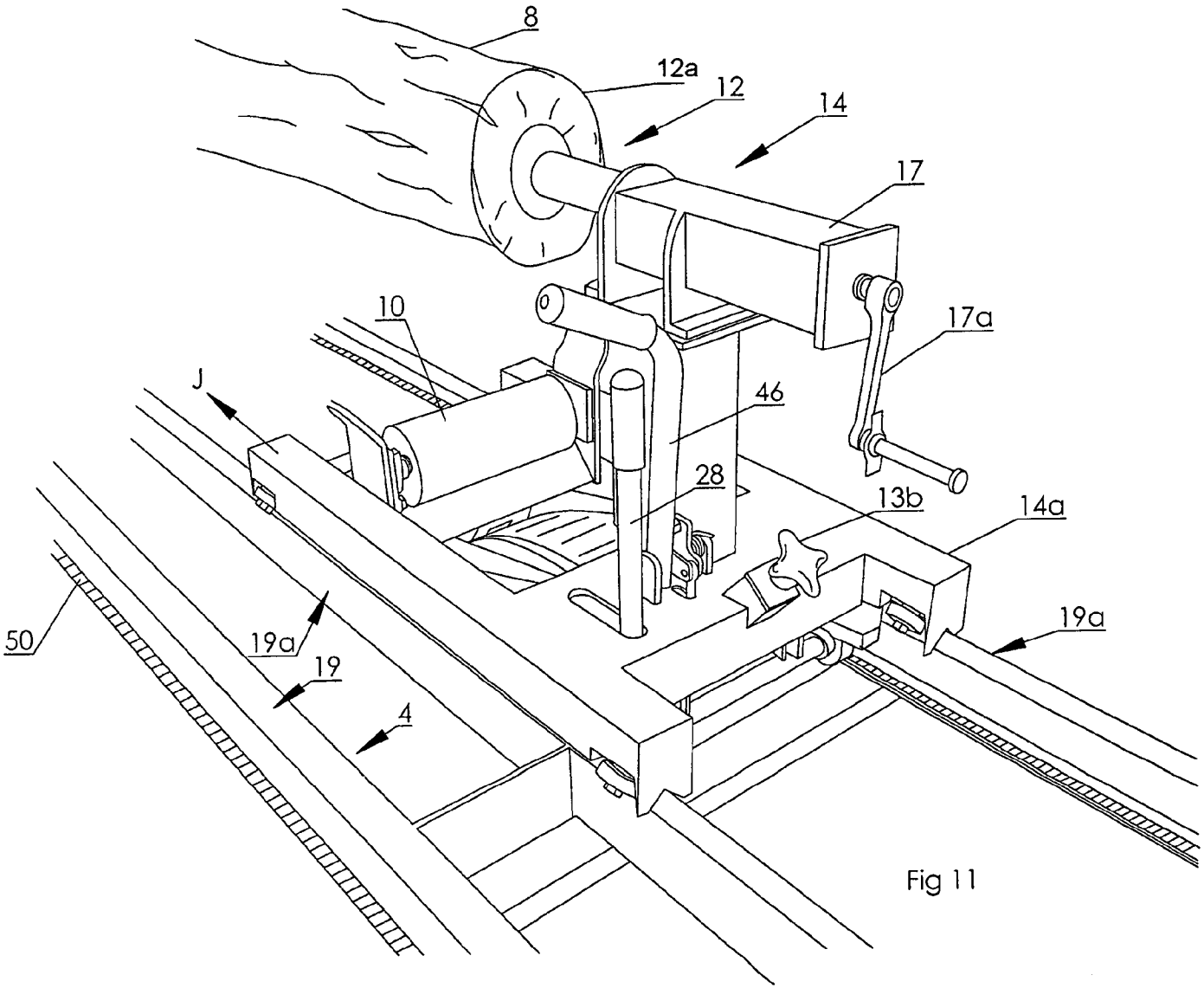
FIG. 11 is, in perspective view, the log end holder of FIG. 6.
Figure 12:
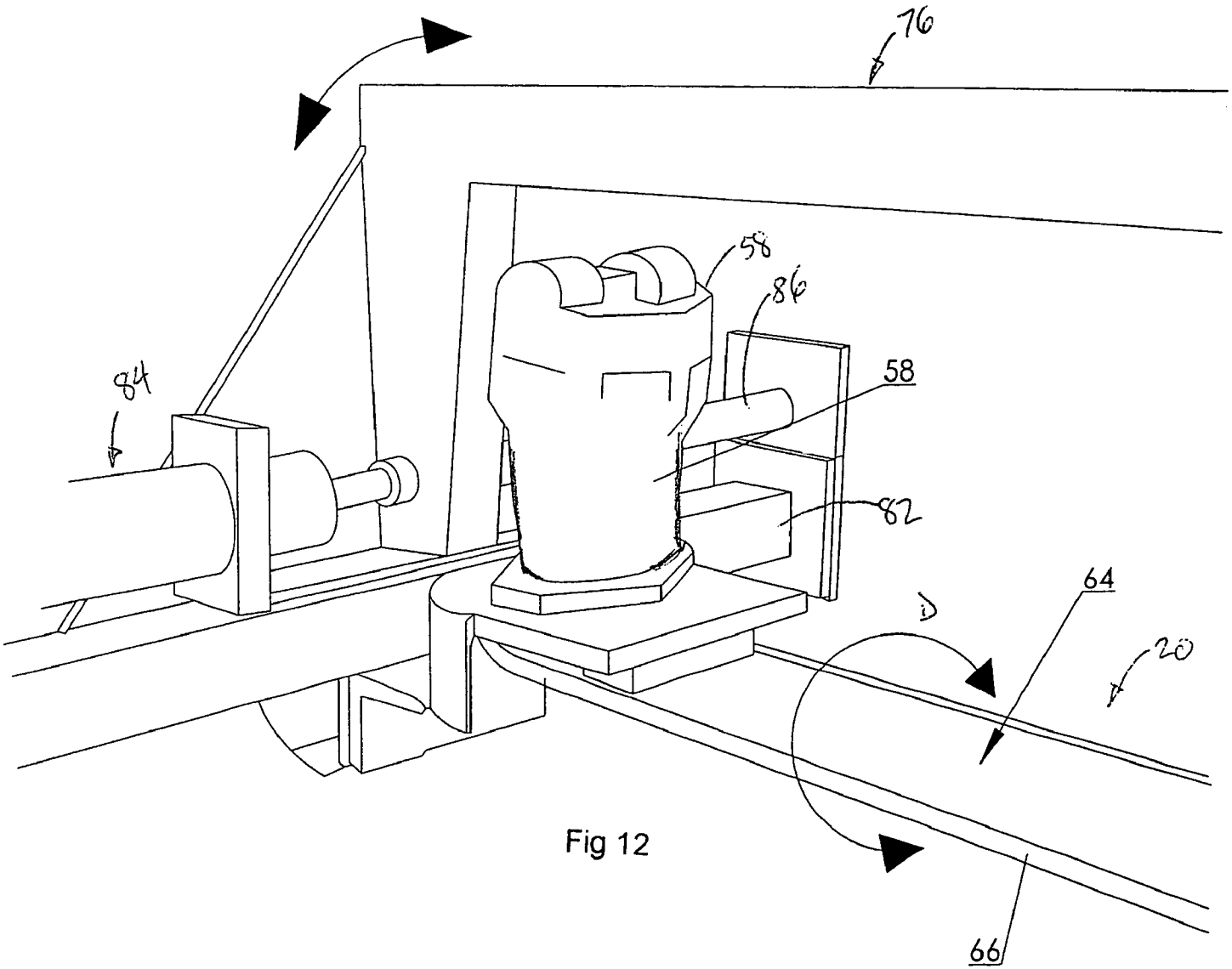
FIG. 12 is, in enlarged perspective view, the saw blade, saw blade drive motor, and saw blade supporting platform.

A linear saw blade 20, for example the chainsaw illustrated, is mounted generally horizontally between the uprights of saw supporting frame 18*b*. Saw blade 20 is supported for movement in a plane C (see FIG. 5) containing the blade and between the saw actuating mechanism mounted to the uprights of saw supporting frame 18*b*. In particular, the saw blade 20 is actuated so as to saw log 8 in a selectable desired orientation of plane C as saw carriage 18 is translated in direction B (see FIG. 2) forwardly and rearwardly along tracks 19. Saw blade 20 cuts in plane C, that is in a sawing path defined by plane C and the direction of translation of saw carriage 18 in direction B. The angular orientation of saw blade 20 as it is inclined in direction D (see FIGS. 4 and 9) from the horizontal, is governed by actuation of rotatable actuators 20*a* mounted on the uprights of saw supporting frame 18*b* and controlled by controls 23*a* on control panel 23. Saw blade 20 and actuators 20*a*, may be vertically translated in direction E (see FIGS. 4 and 5) by means of vertical actuators 20*b*, again controlled by controls 23*a* on control panel 23.

Thus with log 8 securely clamped between rotation drive unit 13 and rotatable carrier 14 so as to pass through the opening defined by saw carriage 18 as saw carriage 18 is translated along tracks 19, saw blade 20 may be selectively positioned and angled so that it profiles log 8 so as to form a desired profiled cant having dovetail, compound-angle jointed ends as saw carriage 18 is moved back and forth along frame 4. Because saw blade 20 may be rotated and pivoted so as to cut any selected angle including horizontal and vertical, saw blade 20 may be pre-positioned vertically so as to engage at the correct height within log 8 for jointing an end of the log and may be then angled and translated during the cut both along the length of the log and so as to translate vertically into the log. This combined with the ability to rotate log 8 about axis of rotation A provides for compound angled cuts required to form compound dovetail joints such as illustrated in FIG. 1.

A parallel pair of spline saws 21 are mounted at the upper end of saw supporting frame 18*b* so as to selectively extend downwardly into the cavity 18*c* defined by saw supporting frame 18*b*. Spline saws 21 may be rotated downwardly so as to engage the upper surface of log 8 to cut parallel grooves 8*c* into the upper surface of log 8. The parallel pair of grooves cut by spline saws 21 provide for splining pairs of logs 8 together in vertically adjacent parallel array as seen in FIG. 1. The pair of parallel grooves 8*c* are cut along the length of log 8 parallel to axis of rotation A. A drill 22 is also provided so as to extend into cavity 18*c* for drilling holes (not shown) into log 8. Such holes are useful for pinning of the logs and for providing conduits for electrical wiring.

Thus as will be understood, the combination of the selectively rotatable log 8 and holders which may be accurately rotated so as to rotate log 8 about axis of rotation A as monitored by the operation of scale 15, and by means of the rotating pivoting saw 20 which rotates and pivots about axis F allows for the cutting of compound dovetail corners, that is, the male end protrusions at the ends of log 8 having compound angled cuts for interleaved mating at a joint such as at a corner with corresponding compound angled cut male protrusions from oppositely disposed logs forming the interleaved dovetailed joint such as illustrated.

The pairs of grooves provided by spline saws 21 allow for the vertically adjacent pairs of logs to be splined together using vertical planar splines 9 without regard to the taper of a particular log or other natural characteristics such as bumps or knots. It also allows for the insertion of insulation between the parallel, spaced apart pair of splines 9 mounted into the corresponding upper and lower pairs of grooves 8*c* while also providing for a more authentic traditional timbered style appearing building. Such splining takes the place of more conventional chinking and also reduces the likelihood of drafts and increases the airtight insulated value of the wall.

In embodiments of the present invention wherein the drives are hydraulic, the saw carriage 18 may also support a hydraulic valve bank 24, a motor 25, and a corresponding hydraulic reservoir 26.

With reference now to log end holder 14, braking system 16 includes a ratchet lever 28 which is rigidly mounted to at its lowermost end so as to rotate a sprocket 30 by the operation of the lever. Lever 28 and sprocket 30 rotate relative to a dogging sprocket 32 over which rides a ratchet and brake dog 34. A roller chain 36 runs along frame 4 and is tensioned by chain tension bolt 38. Roller chain 36 runs underneath an idler sprocket 40 and over sprocket 30 so that rotation of lever 28 in direction H correspondingly rotates sprocket 30 in direction I about shaft 42 to thereby urge trolley 14*a* to which lever 28 is mounted in direction J. Translating trolley 14*a* in direction J engages the tail stock assembly 44 against log end 8*b*.

As described above, saw carriage 18 translates along frame 4, and in particular on tracks 19, on wheels 18*a*. Saw carriage 18 supports, inter alia, saw blade 20 on saw supporting frame 18*b*. Saw carriage 18 is selectively translated along tracks 19 by a selectively actuable feed as better described below. The saw blade 20 and its supporting structure is moved relative to saw supporting frame 18*b* by another feed which both may be actuated to translate saw blade 20 vertically by means of vertical actuators 20*b* and also to rotate the saw blade supporting members relative to saw supporting frame 18*b* so as to angle the blade relative to a log suspended along and over frame 4. Yet a further feed selectively moves the saw blade relative to the saw supporting members so that the saw blade cuts on plane C which is inclined relative to the log.

In particular, and without intending to be limiting, the feed which moves saw carriage 18 along tracks 19 employs a drive sprocket 48 engaging a feed roller chain 50 running along frame 4. Drive sprocket 48 is driven on a shaft 52, itself driven by reduction gears 54 themselves driven by a hydraulic motor 55. Drive sprocket 48 is mounted between a pair of idler sprockets 56. Chain 50 passes underneath idler sprockets 56 and over drive sprocket 48 thereby maintaining driving engagement of drive sprocket 48 with chain 50.

Saw blade 20, including saw blade bar 64 and saw chain 66, its corresponding hydraulic motor 58, and saw blade bar tip support 60 are collectively referred to as cutting head 62. The second feed moves the cutting head 62 vertically relative to saw supporting frame 18*b* and comprises, again without intending to be limiting, four threaded posts or rods, one in each of the four corners defined by the four vertical hollow frame members 68*a*-68*d*. Threaded rods 70 are rotatably mounted so as to extend vertically within hollow frame members 68*a*-68*d*. The uppers ends of threaded rods 70 protrude from the upper ends of their corresponding frame members 68*a*-68*d*. Geared sprockets 72 are mounted on the uppermost ends of threaded rods 70. A continuous linked chain 74 extends endlessly around geared sprockets 72. Consequently, the turning of one of geared sprockets 72 simultaneously turns the remainder of geared sprockets 72 by reason of the rotation of chain 74 continuously around all four geared sprockets. Thus, because the geared sprockets are mounted rigidly onto the ends of rods 70, the driven rotation of chain 74 about geared sprockets 72 thereby simultaneously turns all four threaded rods 70. Chain 74 is driven by hydraulic motor 75 driving drive sprocket 75*a*.

Platform 76 is mounted onto threaded rod 70 by the rotatable mounting of platform 76 to rigid cross members 80, one at each end of platform 76. Cross members 80 are themselves mounted onto the threaded rod 70 by the threaded engagement of threaded collars 81 onto the threaded rods.

Figure 13:
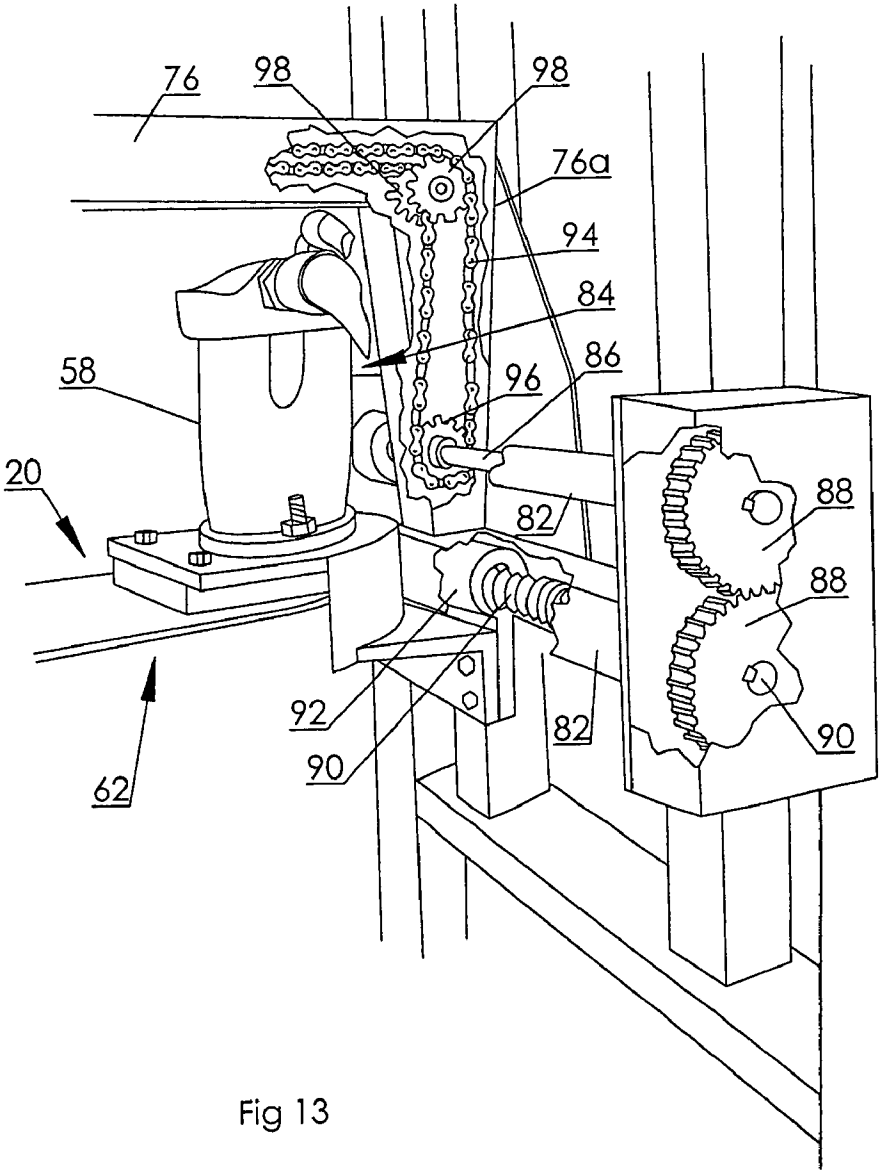
FIG. 13 is, in perspective view, the saw blade, saw blade drive motor, and saw blade supporting platform, viewed from the opposite side from that of FIG. 12, and partially cut away to illustrate the drive gears driving the threaded rod so as to translate the saw relative to the saw supporting platform, and illustrating the endless drive chain within the saw supporting platform which drives the corresponding threaded rod on the opposite side of the saw supporting platform.
Figure 14:
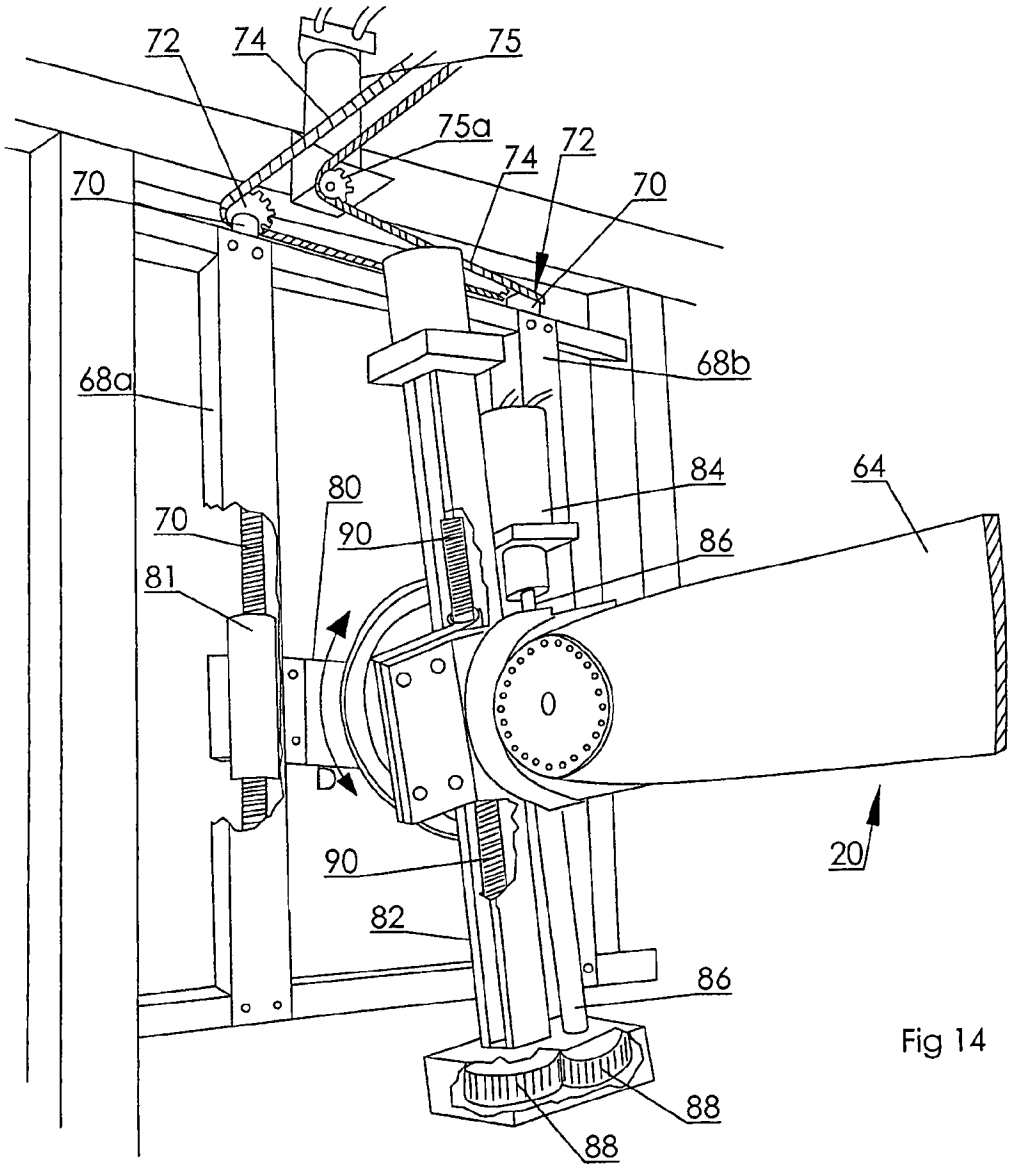
FIG. 14 is, in perspective, partially cut away view, the end of the saw blade illustrated in FIG. 13 mounted on its threaded rod, with the saw supporting platform cut away for clarity and the saw head assembly rotated for nearly vertical cutting, the saw carriage supports partially cut away to show one of the four threaded rods which are driven by an endless drive chain so as to raise and lower the saw supporting platform.

Cutting head 62 is mounted to platform 76. In one embodiment, platform 76 is a U-shaped rigid frame having the cutting head 62 mounted so as to extend across the opening in the U-shaped frame as defined by the pair of legs 76*a* of platform 76. The tertiary feed mechanism is mounted to the distal ends of legs 76*a*. In particular, a pair of hollow elongate housing members 82 are mounted perpendicular to legs 76*a* at the distal end of one of the legs. Members 82 support the tertiary feed mechanism and in particular, hydraulic motor 84, drive shaft 86, and gears 88 driving threaded rod 90. Each end of cutting head 62 is coupled to a corresponding threaded rod 90 by corresponding threaded collars 92. A take-off chain drive 94 is driven as an endless drive chain by sprocket 96 mounted on drive shaft 86. Chain drive 94 runs along the length of the U-shaped platform 76, within its hollow interior, on idler sprockets 98. A pair of parallel threaded rods 90 on either side of platform 76 are thereby driven simultaneously by hydraulic motor 84 and drive shaft 86 and thus cutting head 62 may be selectively translated in direction K. Only one threaded rod 90, on one side of platform 76 is illustrated in FIG. 13. Platform 76 is rotated relative to supporting frame 18*b* by actuation of hydraulic motor 100 driving shaft 102 via 30:1 reduction unit 101. Rotation of the platform and saw is locked in position by brake drum 104. Platform 76 rotates on bearing contained within bearing housings 106 supported on cross members 80.

Figure 15:
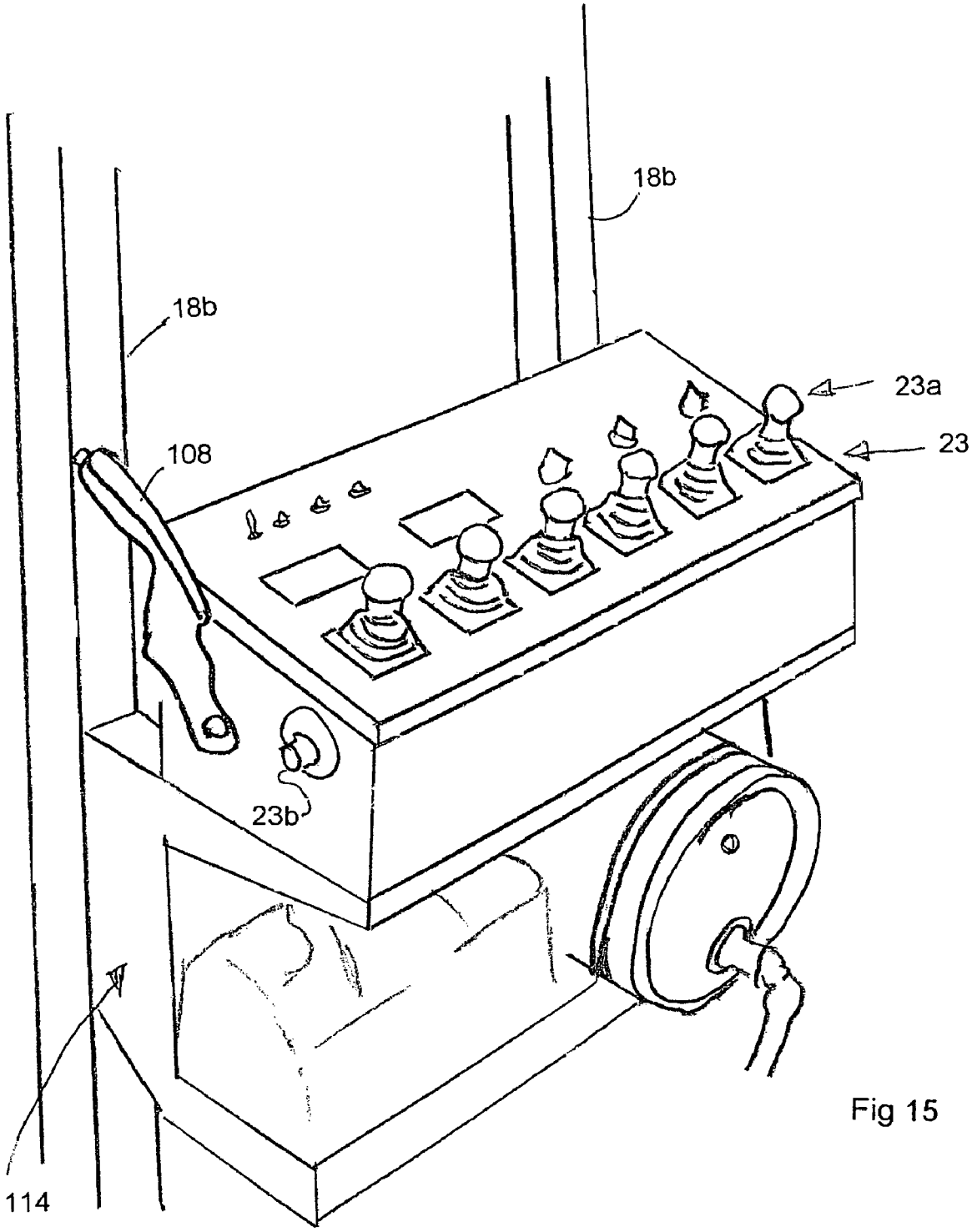
FIG. 15 is, in perspective view, the control console of the apparatus of FIG. 2.

Control panel 23 may be mounted to supporting frame 18*b* so as to dispose controls 23*a* for ease of operation. In one embodiment not intended to be limiting, the control 23*a* illustrated in FIG. 15 are, respectively, in respect of the control joy sticks shown, and from right to left, for:

(1) actuating drill 22, the power switch for drill 22 being mounted adjacent,
(2) actuating raising and lowering the spline saws 21, the corresponding power switch being located adjacent,
(3) actuating translation of saw carriage 18, the power switch for saw 20 being located adjacent,
(4) actuation of saw 20 relative to platform 76, that is the tertiary feed,
(5) actuating raising and lowering of saw 20, that is the secondary feed to move the blade and blade support including platform 76 vertically relative to supporting frame 18*b*,
(6) actuation of rotation of saw 20.

Actuation of brake drum 104 is by pulling brake lever 108. Brake cable 108*a* extends from brake lever 108 to brake drum 104. A fuel supply 110 and a chain saw bar oil supply 112 may be conveniently located underneath control panel 23 and supported on control panel mounting frame 114. Chain saw bar oil supply 112 feeds a chain oil pump (not shown) for continuous lubrication of saw 20.

Figure 16:
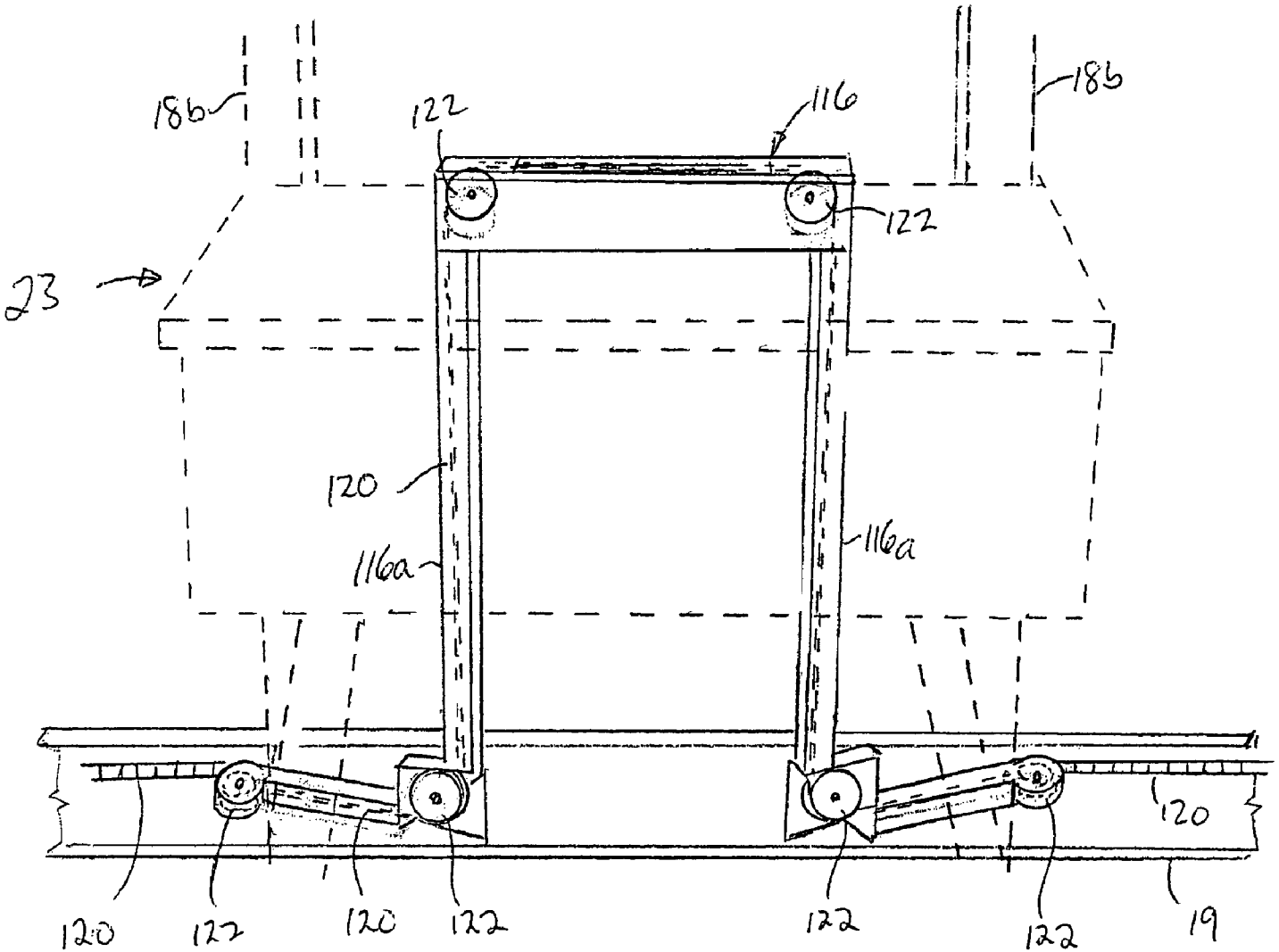
FIG. 16 is, in front perspective view, the view of FIG. 15 with the control console shown in dotted outline so as to view the tape measure support mechanism mounted therein behind.
Figure 17:
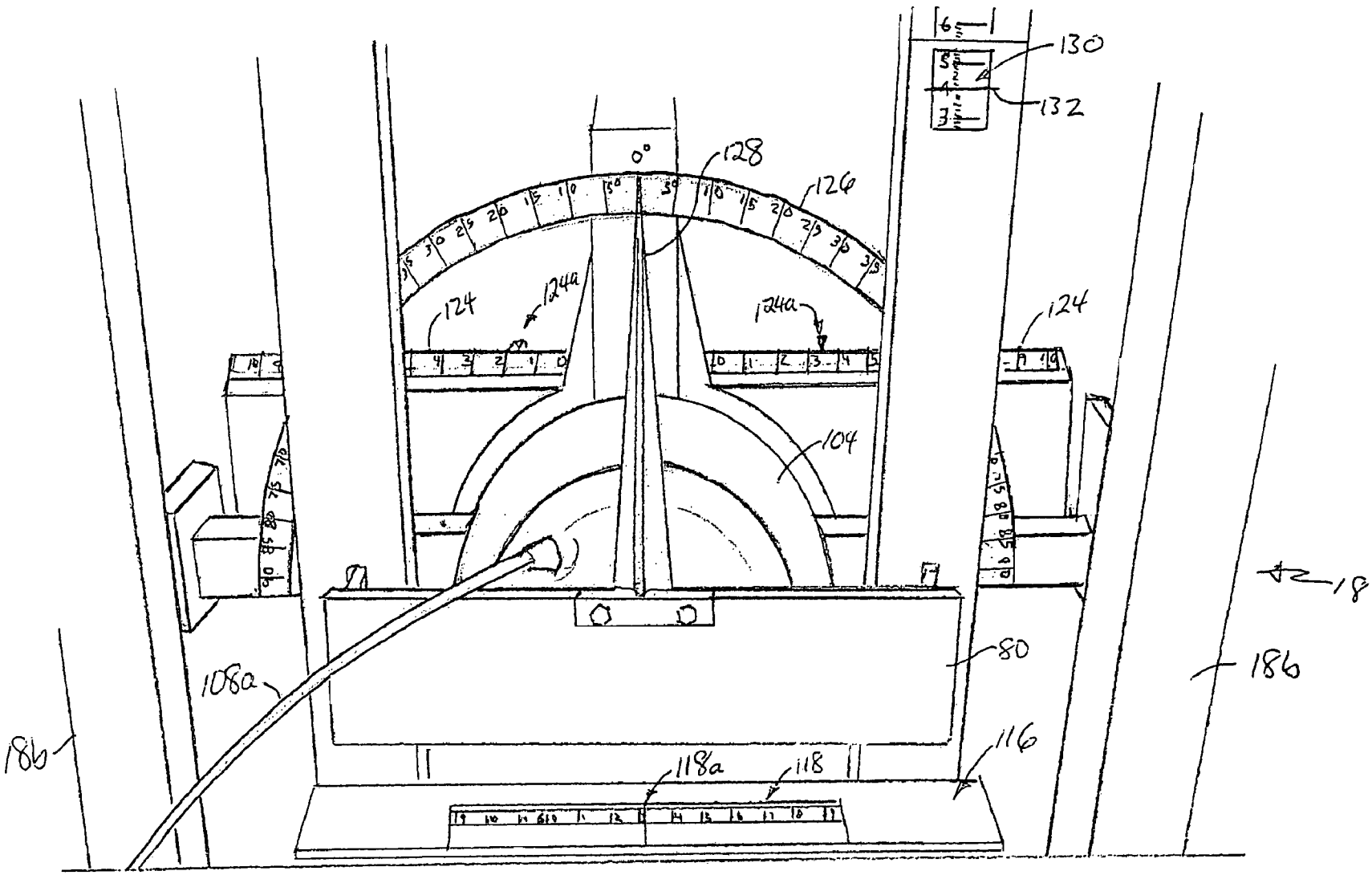
FIG. 17 is, in front perspective view, the top of the tape measure support apparatus of FIG. 16 and the cut depth, angle of cut, and elevation of the cutting head scales mounted therein behind.

As seen in FIG. 16, a linear measuring system includes a tape measure display 116 mounted between supporting frame 18*b* adjacent control panel 23 for displaying the position of saw carriage 18 along rails 19 as indicated by the position line indicator 118*a* on tape display window 118 as better seen in FIG. 17. Tape measure 120 is mounted so as to extend under tension along a corresponding rail 19. Tape measure 120 passes under idler rollers 122 so as to be directed upwardly in and along the vertically extending legs 116*a* so as to be displayed horizontally across tape display 116 underneath tape display window 118.

Tape display 116 is mounted to saw carriage 18 so that, as saw carriage 18 translates along rails 19, the tape measure 120 which is affixed to one of the rails, continuously runs on idler rollers 122 thereby continuously indicating the longitudinal position of saw carriage 18, and thereby the longitudinal position of saw blade 20. In one embodiment, line indicator 118*a* indicates the leading edge of saw blade 20, the width of saw blade 20 which is for example five inches, having to be taken into account for setting the blade for its cut depending on which direction of cut is desired. Advantageously, a further linear measurement scale 124 is also provided mounted on the saw carriage. Indicators 124*a* which are spaced apart by the width of the saw blade, move with the movement of the saw blade so as to indicate to an operator where the rearward and leading edge of the saw blade presently are positioned relative to the saw carriage. Scale 124 therefore indicates the depth of cut as saw blade 20 moves relative to platform 76, scale 124 advantageously being mounted so as to rotate as platform 76 is rotated.

A further semi-circular scale 126 is also mounted in cooperation with platform 76 for rotation therewith. A rigid pointer 128 mounted to cross bar 80 indicates the amount of rotation of platform 76 relative to saw carriage 18 to thereby indicate the angle of the saw head, that is, the inclination of saw blade 20. Lastly, a further linear scale 130 is mounted under a corresponding window having a position indicator line 132. Scale 130 and indicator line 132 are mounted so as to move relative to one another responding to the vertical movement of saw blade 20 and it's supporting structure including platform 76 relative to saw carriage 18 and saw supporting frame 18*b*. Thus, scale 130 indicates the height of the saw head, advantageously, measured from the center line of the log when mounted in the log holders.

Figure 18:
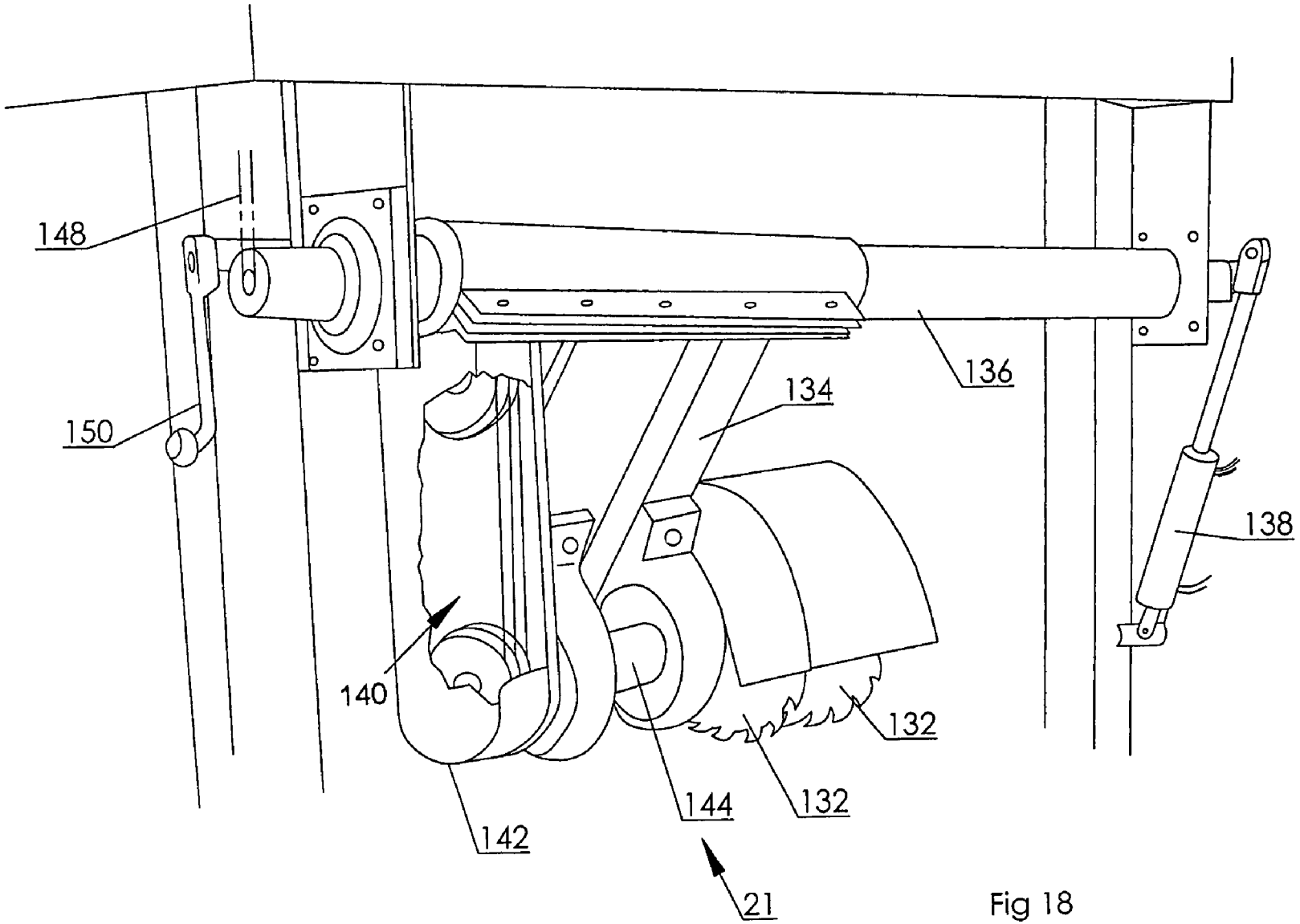
FIG. 18 is, in perspective partially cut away view, the splining saws mounted on the saw carriage supports.

As seen in FIG. 18, spline saws 21 include a parallel pair of circular saws 132 mounted on a swing arm 134. Swing arm 134 is mounted to shaft 136. Location of shaft 136 so as to thereby raise or lower circular saws 132 is governed by actuation of cylinder 138. Circular saws 132 are driven by belt drive 140 within drive housing 142 driving drift shaft 144 on which saws 132 are mounted.

The depth of cut is indicated by scale 146 cooperating with pointer 148. Pointer 148 is mounted to the end of shaft 136 and rotates as shaft 136 rotates.

A locking lever 150 actuates a locking device (not shown) which prevents saws 132 from accidentally dropping down or from drooping due to possible seeping of the hydraulics actuating cylinder 138.

Figure 3:
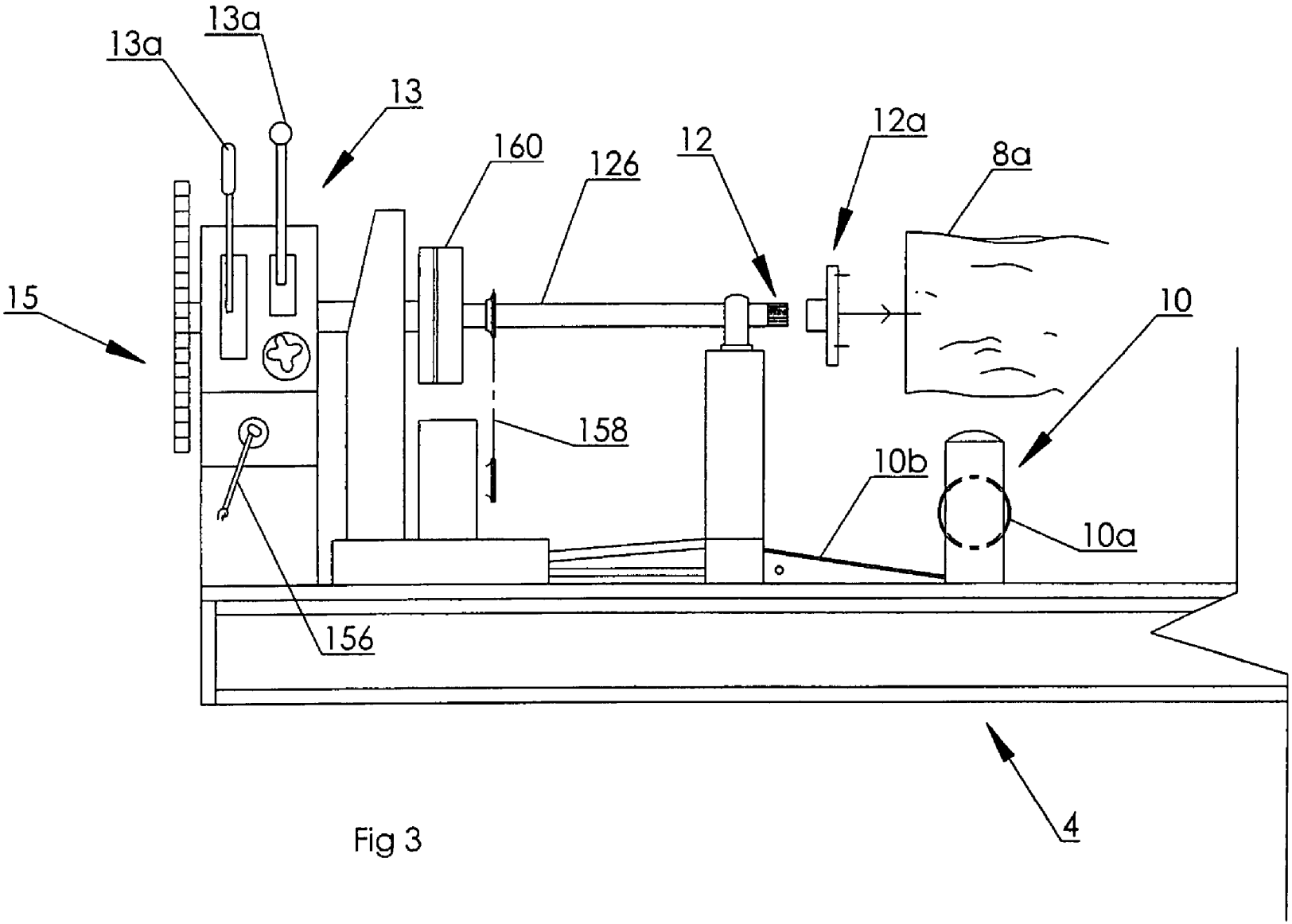
FIG. 3 is an enlarged view of the left hand side of FIG. 2 illustrating one log end holder assembly.
Figure 3A:
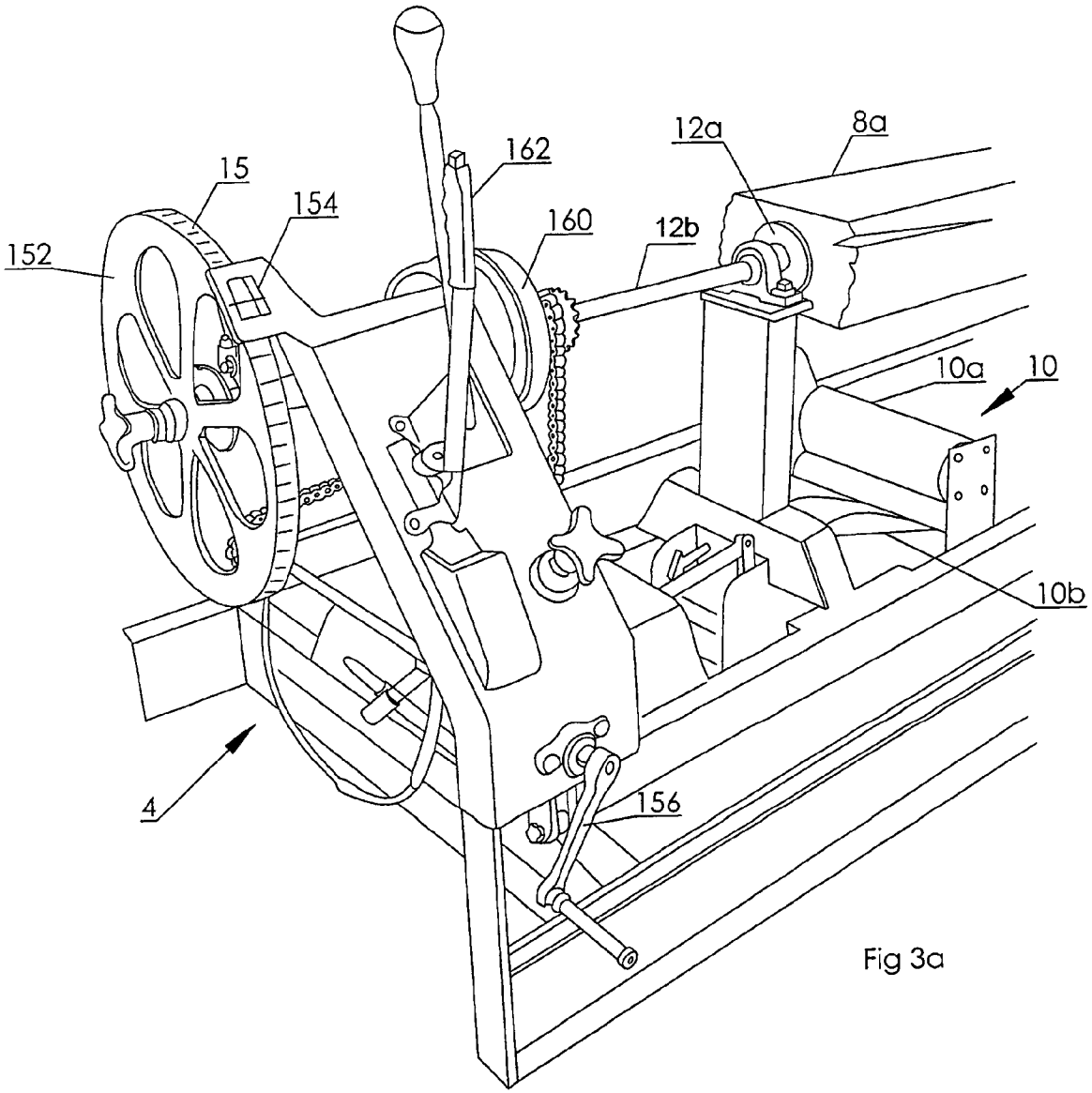
FIG. 3*a* is, in perspective view, the log end holder of FIG. 3.

With reference to FIG. 3*a*, scale 15 is mounted around the circumference of wheel 152. Wheel 152 is mounted onto the end of the shaft 12*b* on which is mounted mounting plate 12*a* so as to engage log end 8*a*. Wheel 152 thus rotates with rotation of shaft 12*b* so that scale 15 as read through window 154 indicates the amount of rotation of log 8 relative to frame 4. Once the desired angular orientation of the log is achieved by the rotation of crank 156 turning drive chain 158, brake drum 160 may be actuated by lever 162 so as to lock the angular orientation of the log.

In operation, once a log is mounted into the log end holders, the log is rotated into the desired position for production of a cant, and the saw positioned so as to saw off the side board to produce the cant and the main carriage translated then between the log end holders so as to remove the side board, following which, the two sided cant is produced by rotating the log one hundred eighty degrees and again translating the main carriage the length of the log to remove a second side board.

Dovetails are formed in the opposite ends of the cant by the use of the second feed comprising the motor 84 and drive system 86, 88 and 90. In particular, to form the dovetail cuts, the main carriage is translated and stopped at the desired position for the cut according to the position indicated on scale 118*a* and 118. The height for the cut is adjusted to the desired elevation using scale 130 and the pointer 132. The cutting head is rotated to the desired position using scales 126 and 128 so as to set the desired degree of the dovetail, usually about ten degrees. The main saw 66 is then actuated using the switch on the panel, and a user while looking at scale 124 moves the second feed lever either up or down to engage hydraulic motor 84 and drive system 86, 88 and 90 to translate the cutting assembly in direction K. The user watches pointer 124*a* as it moves along scale 124 so that, when the desired depth of cut of the dovetail is reached, the user releases the actuating lever stopping further cutting. This produces a dovetail cut at either end of the cant. The same procedure is followed to produce a vertical cut in the cant except the cutting head rotation as indicated on scales 126 and 128 is rotated to ninety degrees. The depth of cut is monitored by the user and the log position adjusted for example for removing of the waste wood from the dovetail cut.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A log profiler for sawing surfaces into and along the length of a log;

the profiler comprising:

an elongate frame having opposite first and second ends, a track rigidly mounted onto said frame from said first end to said second end, a saw carriage mounted onto said track for selective translation of said carriage longitudinally in both forward and reverse directions along said track and defining a sawing cavity over said track, a double-acting saw blade mounted on a feed for selective translation therealong, said feed mounted on a blade carriage, said blade carriage rotatably mounted for rotation of said blade and feed about a transverse axis and vertically translatable in said saw carriage, said blade carriage mounted in said cavity so as to dispose said blade across said cavity and laterally across said track and so that rotation of said blade carriage rotates said blade and said feed about said transverse axis extending along the length of said blade relative to a log mounted parallel to said track and journalled through said cavity, wherein said double-acting saw blade is adapted to saw the log in both said forward and reverse directions, first and second log holders rotatably mounted, respectively, at said first and second ends of said frame and aligned with said track and selectively positionable relative to said track so that the log is held clamped between said log holders and substantially horizontally parallel to said track in a cutting path of said blade, said log holders said rotatably mounted so as to be selectively rotatable about an axis of rotation of said log, said log holders adapted for mounting to the opposite ends of the log at substantially the centroids of said opposite ends so that rotation of said log about said axis of rotation rotates the log about substantially a centroidal longitudinal axis of the log, a log rotation drive mounted at said first log holder for selectively rotating the log about said axis of rotation by a desired angle for canting the log or dovetail jointing the ends of the log so that translation of said saw carriage along said track when said blade is positioned for cutting engagement with the log cuts the log along said cutting path to thereby cant the log when said saw carriage is translated the length of the log, or to position the log about its longitudinal axis for cutting compound dovetail-joint ends in the log, wherein when cutting said compound dovetail-joint ends said blade carriage and log are positioned to angle said blade at a compound angle relative to the log by rotation of the log to a first angle of said compound angle and by rotation of said blade about said lateral axis so as to incline said blade to a second angle of said compound angle, wherein said first and second angles are orthogonal to one another, so that a compound angle joint saw cut is made at said compound angle as said saw is translated on said feed inwardly from an end being jointed.

2. The log profiler of claim 1 further comprising double spline cutting saws mounted to said saw carriage and within said cavity for cutting a parallel, transversely spaced apart pair of longitudinally extending substantially linear spline receiving grooves along the length of the log, said spline cutting saws mounted so as to be selectively movable relative to said saw carriage into cutting engagement with the log.

3. The log profiler of claim 1 further comprising a calibrated scale cooperating with said log rotation drive so as to indicate to a user an angular displacement of the log by said log rotation drive about said axis of rotation.

4. The log profiler of claim 3 wherein said scale is mounted for rotation co-axially with said log whereby said angular displacement is indicated directly by corresponding rotation of said scale.

5. The log profiler of claim 1 wherein said double acting saw blade is substantially linear.

6. The log profiler of claim 1 wherein said axis of rotation and said transverse axis are orthogonal and substantially horizontal.

7. The log profiler of claim 1 wherein said saw carriage is formed as an inverted, substantially U-shape having uprights extending vertically on opposite sides of the log and said cutting path, and wherein said feed is a linear actuator for actuating said blade along a plane which is selectively inclined by rotation of said blade carriage.

8. The log profiler of claim 2 wherein said saw carriage is formed as an inverted, substantially U-shape having uprights extending vertically on opposite sides of the log and said cutting path, and wherein said feed is a linear actuator for actuating said blade along a plane which is selectively inclined by rotation of said blade carriage.

9. The log profiler of claim 8 wherein said double spline cutting saws are mounted to an upper end of said saw carriage and are selectively lowerable downwardly into said cavity to engage an upper surface of the log.

10. The log profiler of claim 7 wherein said saw blade is mounted to, so as to extend between, said uprights.

11. The log profiler of claim 10 wherein said saw blade is substantially linear, extending along said transverse axis, and further comprising a saw drive mounted to said saw carriage and cooperating with said saw blade for actuating said saw blade for sawing the log.

12. The log profiler of claim 11 wherein said saw blade is a chainsaw, actuated by said saw drive so as to saw substantially along said transverse axis.

13. A method of profiling and compound-angle jointing a log comprising the steps of:

a) providing:

(i) an elongate frame having opposite first and second ends (ii) a track rigidly mounted onto said frame from said first end to said second end (iii) a saw carriage mounted onto said track for selective translation of said carriage longitudinally in both forward and reverse directions along said track and defining a sawing cavity over said track, (iv) a double-acting saw blade mounted on a feed for selective translation therealong, said feed mounted on a blade carriage, said blade carriage rotatably mounted for rotation of said blade and said feed about a transverse axis and vertically translatable in said saw carriage, said blade carriage mounted in said cavity so as to dispose said blade across said cavity and laterally across said track and so that rotation of said blade carriage rotates said blade and said feed about said transverse axis extending along the length of said blade relative to a log mounted parallel to said track and journalled through said cavity, wherein said double-acting saw blade is adapted to saw the log in both said forward and reverse directions, (v) first and second log holders rotatably mounted, respectively, at said first and second ends of said frame and aligned with said track and selectively positionable relative to said track so that the log is held clamped between said log holders and substantially horizontally parallel to said track in a cutting path of said blade, said log holders said rotatably mounted so as to be selectively rotatable about an axis of rotation of said log, said log holders adapted for mounting to the opposite ends of the log at substantially the centroids thereof so that rotation of said log about said axis of rotation rotates the log about substantially a centroidal longitudinal axis of the log, (vi) a log rotation drive mounted at said first log holder for selectively rotating the log about said axis of rotation by about a desired angle for canting the log or dovetail jointing the ends of the log so that translation of said saw carriage along said track when said blade is positioned for cutting engagement with the log cuts the log along said cutting path to thereby cant the log when said saw carriage is translated the length of the log, or to position the log about its longitudinal axis for cutting compound dovetail-joint ends in the log, wherein when cutting said compound dovetail-joint ends said blade carriage and log are positioned to angle said blade at a compound angle relative to the log by rotation of the log to a first angle of said compound angle and by rotation of said blade about said lateral axis so as to incline said blade to a second angle of said compound angle, wherein said first and second angles are orthogonal to one another, so that a compound angle joint saw cut is made at said compound angle as said saw is translated on said feed inwardly from an end being jointed, b) determining a desired cant profile for the log, c) rotating the log to an angular orientation about said axis of rotation corresponding to said desired cant profile so that sawing by said saw blade along said cutting path produces said desired cant profile, d) determining said first and second angles and corresponding angular orientations of said log about said axis of rotation and said saw blade about said transverse axis, e) positioning said log and said saw blade for sawing along said first and second angles to thereby saw a compound angle joint in an end of the log, f) actuating said saw blade so as to saw the log and simultaneously translating said saw blade to translate said saw blade longitudinally relative to the log and to simultaneously translate said saw blade on said feed inclined or otherwise selectively oriented relative to the log so as to follow said first and second angles to produce said compound-angle joint in said end of the log.

14. The method of claim 13 further comprising the step of providing double spline cutting saws mounted to said saw carriage and within said cavity for cutting a parallel, transversely spaced apart pair of longitudinally extending substantially linear spline-receiving grooves along the length of the log, said spline cutting saws mounted so as to be selectively movable relative to said saw carriage into cutting engagement with the log.

15. The method of claim 13 further comprising the step of providing a calibrated scale cooperating with said log rotation drive so as to indicate to a user an angular displacement of the log by said log rotation drive about said axis of rotation.

16. The method of claim 15 further comprising the step of providing said scale mounted for rotation co-axially with said log whereby said angular displacement is indicated directly by corresponding rotation of said scale.

17. The method of claim 13 wherein said saw blade is a substantially linear chainsaw.

18. The method of claim 13 wherein said axis of rotation and said transverse axis are orthogonal and substantially horizontal.

19. The method of claim 13 wherein said saw carriage is formed as an inverted, substantially U-shape having uprights extending vertically on opposite sides of the log and said cutting path, further comprising the step of sawing the log by movement of said carriage over and along the log so as to run the log through said cavity.

20. The method of claim 14 wherein said saw carriage is formed as an inverted, substantially U-shape having uprights extending vertically on opposite sides of the log and said cutting path, further comprising the step of sawing the log by movement of said carriage over and along the log so as to run the log through said cavity.

21. The method of claim 20 wherein said double spline cutting saws are mounted to an upper end of said saw carriage so as to depend downwardly into said cavity to engage an upper surface of the log, and further comprising the step of lowering said spline cutting saws and sawing said corresponding pair of spline-receiving grooves in the log.

22. The method of claim 19 wherein said saw blade is mounted to, so as to extend between, said uprights, and further comprising the step of inclining said saw blade to said second angle and traversing said saw blade vertically so as to saw inclined into an end of the log during simultaneous movement of said saw on said feed.

23. The method of claim 22 wherein said saw blade is substantially linear, extending along said transverse axis, and further comprising the step of providing a saw drive mounted to said saw carriage and cooperating with said saw blade for actuating said saw blade for sawing the log.

24. The method of claim 13 further comprising the steps of measuring desired saw cuts for canting the log or jointing an end of the log from said centroidal axis of the log extending longitudinally along the log and said axis of rotation.

25. The method of claim 16 farther comprising the steps of measuring desired saw cuts for canting the log or jointing an end of the log from said centroidal axis of the log extending longitudinally along the log and said axis of rotation, and further comprising the step of measuring said first angle using said scale so as to rotate the log about said axis of rotation to an angular orientation corresponding to said first angle.

* * * * *